US009885218B2

(12) United States Patent
Heijnen et al.

(10) Patent No.: US 9,885,218 B2
(45) Date of Patent: Feb. 6, 2018

(54) DOWNHOLE APPARATUS

(75) Inventors: Wilhelmus Hubertus Paulus Maria Heijnen, Stromberg (DE); Robert Bouke Peters, Aberdeen (GB)

(73) Assignee: MAERSK OLIE OG GAS A/S, Copenhagen K (DK)

( * ) Notice: Subject to any disclaimer, the term of this patent is extended or adjusted under 35 U.S.C. 154(b) by 275 days.

(21) Appl. No.: 13/505,238

(22) PCT Filed: Oct. 27, 2010

(86) PCT No.: PCT/EP2010/066233

§ 371 (c)(1), (2), (4) Date: Jul. 18, 2012

(87) PCT Pub. No.: WO2011/051321

PCT Pub. Date: May 5, 2011

(65) Prior Publication Data

US 2012/0313790 A1 Dec. 13, 2012

Related U.S. Application Data

(60) Provisional application No. 61/256,691, filed on Oct. 30, 2009.

(30) Foreign Application Priority Data

Oct. 30, 2009 (DK) ..... 2009 70180

(51) Int. Cl.
*E21B 4/18* (2006.01)
*E21B 47/12* (2012.01)
(Continued)

(52) U.S. Cl.
CPC ..... *E21B 23/14* (2013.01); *E21B 4/18* (2013.01); *E21B 47/122* (2013.01); *E21B 2023/008* (2013.01)

(58) Field of Classification Search
CPC .. E21B 47/12; E21B 47/122; E21B 2023/008; E21B 4/18; E21B 33/127;
(Continued)

(56) References Cited

U.S. PATENT DOCUMENTS 2,122,697 A 10/1935 Potter
3,926,254 A * 12/1975 Evans et al. ..... 166/106
(Continued)

FOREIGN PATENT DOCUMENTS

DE 2358371 A1 5/1975
EP 1223305 A2 7/2002
(Continued)

OTHER PUBLICATIONS

"The Development of Novel Down-Hole Intervention Tools, a Change in Well Technology (SPE 122822)", Proceedings of Offshore Europe, Sep. 8, 2009 (Sep. 8, 2009), pp. 1-14, XP055061112, DOI: 10.2118/122822-MS ISBN: 978-1-55-563261-8, the whole document.

(Continued)

*Primary Examiner* — Fekadeselassie Girma
(74) *Attorney, Agent, or Firm* — Brinks Gilson & Lione

(57) ABSTRACT

An apparatus (100) for operation in a tubular channel (199), the apparatus comprising a first part and a second part connected to the first part, wherein the second part comprises a first electronic device adapted to generate a data signal and a first communications device for wirelessly transmitting the generated data signal via a wireless communications channel, wherein the first part comprises a second communications device for wirelessly receiving the transmitted data signal via said radio-frequency communications channel.

35 Claims, 17 Drawing Sheets

(51) Int. Cl.
*E21B 23/14* (2006.01)
*E21B 23/00* (2006.01)

(58) Field of Classification Search
CPC ..... E21B 23/14; E21B 43/14; E21B 17/028; E21B 17/18; E21B 33/068; E21B 33/1208; H04B 10/25; H04B 5/0025
USPC ..... 340/853.3, 854.4, 855.4, 856.2; 166/382, 166/212, 241.5
See application file for complete search history.

(56) References Cited

U.S. PATENT DOCUMENTS 3,937,278 A 2/1976 Sheshtawy
4,320,800 A * 3/1982 Upchurch ..... 166/106
4,365,676 A 12/1982 Boyadjieff et al.
4,611,405 A 9/1986 Van Steenwyk
4,621,532 A 11/1986 Takagi et al.
4,914,433 A * 4/1990 Galle ..... E21B 47/122 340/854.4
4,919,223 A 4/1990 Egger et al.
5,070,941 A 12/1991 Kilgore
5,558,153 A * 9/1996 Holcombe et al. ..... 166/373
5,955,666 A 9/1999 Mullins
6,057,784 A * 5/2000 Schaaf ..... E21B 47/12 324/338
6,241,028 B1 6/2001 Bijleveld et al.
6,253,850 B1 7/2001 Nazzal et al.
7,174,974 B2 2/2007 Bloom et al.
7,230,541 B2 * 6/2007 Ripolone et al. ..... 340/853.2
7,392,859 B2 * 7/2008 Mock et al. ..... 175/99
7,493,967 B2 * 2/2009 Mock et al. ..... 175/57
7,607,497 B2 * 10/2009 Mock et al. ..... 175/99
7,954,563 B2 * 6/2011 Mock et al. ..... 175/99
8,069,917 B2 * 12/2011 Bloom et al. ..... 166/212
8,109,331 B2 * 2/2012 Lynde et al. ..... 166/105.3
8,151,902 B2 * 4/2012 Lynde et al. ..... 175/51
8,245,796 B2 * 8/2012 Mock et al. ..... 175/51
8,555,963 B2 * 10/2013 Bloom et al. ..... 166/206
8,602,115 B2 * 12/2013 Aguirre et al. ..... 166/382
8,776,591 B2 * 7/2014 Le Foll ..... E21B 43/14 73/152.17
9,080,388 B2 * 7/2015 Heijnen ..... E21B 4/18
9,567,849 B2 * 2/2017 Graf ..... E21B 47/122
9,587,487 B2 * 3/2017 Walton ..... E21B 47/122
2001/0045300 A1 * 11/2001 Fincher et al. ..... 175/26
2002/0029908 A1 * 3/2002 Bloom ..... E21B 4/18 175/99
2002/0088648 A1 * 7/2002 Krueger et al. ..... 175/99
2002/0096322 A1 7/2002 Barrett et al.
2002/0112859 A1 * 8/2002 Bloom et al. ..... 166/381
2002/0190682 A1 12/2002 Schempf et al.
2003/0098799 A1 * 5/2003 Zimmerman ..... E21B 47/122 340/854.6
2003/0102164 A1 6/2003 Odell, II et al.
2003/0192707 A1 * 10/2003 Guven et al. ..... 166/380
2003/0197612 A1 * 10/2003 Tanaka ..... G06K 17/00 340/572.1
2004/0065445 A1 4/2004 Simpson et al.
2004/0078227 A1 * 4/2004 Morris ..... G06F 19/322 705/2
2004/0090230 A1 * 5/2004 Appel et al. ..... 324/307
2004/0165063 A1 * 8/2004 Iida ..... G07C 9/00111 348/143
2004/0182580 A1 9/2004 Moore et al.
2004/0211883 A1 * 10/2004 Imagawa ..... G01S 11/14 250/208.1
2004/0226746 A1 11/2004 Schmidt et al.
2004/0226747 A1 11/2004 Stegmaier et al.
2004/0239777 A1 * 12/2004 Nakamura ..... H04N 1/00132 348/239
2004/0262008 A1 * 12/2004 Deans ..... E21B 41/0007 166/339
2005/0150692 A1 7/2005 Ballantyne et al.
2005/0179553 A1 * 8/2005 Fujie ..... G08B 13/19613 340/573.4
2005/0262944 A1 * 12/2005 Bennett et al. ..... 73/592
2006/0044156 A1 * 3/2006 Adnan ..... E21B 47/12 340/854.9
2006/0180316 A1 8/2006 Steele et al.
2006/0196694 A1 9/2006 Bloom et al.
2006/0267770 A1 * 11/2006 Sanari ..... G08B 13/19645 340/572.1
2006/0280496 A1 * 12/2006 Tanoue ..... H04N 1/00129 396/287
2007/0256861 A1 * 11/2007 Hulick ..... E21B 4/20 175/26
2008/0066963 A1 3/2008 Sheiretov et al.
2008/0073077 A1 3/2008 Tunc et al.
2008/0121429 A1 * 5/2008 Bamford ..... E21B 7/12 175/5
2008/0159077 A1 * 7/2008 Madhavan et al. ..... 367/76
2008/0211687 A1 * 9/2008 Price ..... E21B 17/028 340/854.3
2008/0308318 A1 * 12/2008 Moore ..... E21B 4/04 175/51
2009/0051246 A1 * 2/2009 Mueller ..... H01L 41/053 310/313 R
2009/0200290 A1 * 8/2009 Cardinal et al. ..... 219/488
2009/0205840 A1 8/2009 O'Connor et al.
2009/0211754 A1 * 8/2009 Verret et al. ..... 166/250.12
2009/0218105 A1 9/2009 Hill et al.
2010/0011853 A1 * 1/2010 Anthony ..... E21B 47/011 73/152.02
2010/0116550 A1 * 5/2010 Hutin ..... E21B 17/003 175/40
2010/0126716 A1 * 5/2010 Joseph ..... 166/244.1
2010/0133006 A1 * 6/2010 Shakra et al. ..... 175/24
2010/0148987 A1 * 6/2010 Spross ..... E21B 47/18 340/854.3
2010/0332137 A1 * 12/2010 Meadows ..... E21B 47/02216 702/6
2011/0067926 A1 * 3/2011 Moore ..... 175/325.3
2012/0292049 A1 * 11/2012 Heijnen ..... E21B 4/18 166/381
2014/0174732 A1 * 6/2014 Goodwin ..... E21B 33/13 166/255.1
2014/0184185 A1 * 7/2014 Torrisi ..... G05F 1/462 323/277

FOREIGN PATENT DOCUMENTS

FR 1561771 A 3/1969
GB 2234278 A 1/1991
GB 2275066 A 8/1994
GB 2368082 A 4/2002
WO WO 98/12418 3/1998
WO WO 00/36266 6/2000
WO WO 02/070943 A2 9/2002
WO 2008/024881 A1 2/2008

OTHER PUBLICATIONS

Search Report for DK application PA 2011 70110, dated Nov. 7, 2011.
Supplemental Search Report for DK application PA_2011_70110, dated Apr. 16, 2013.
PCT/EP2012/052447 International Search Report and Written Opinion, dated Jul. 5, 2013.
International Search Report for PCT/EP2010/066233, dated Feb. 16, 2011.
Written Opinion for PCT/EP2010/066233, dated Feb. 16, 2011.
PCT International-Type Search Report for DK 200901032, dated Apr. 7, 2010,4 pages.
Search Report for Application No. PA 200901032, dated Apr. 13, 2010, 1 page.
International Search Report for International Application No. PCT/EP2010/066376, dated Dec. 8, 2010.
International Search Report for corresponding International application No. PCT/EP2010/068762, dated Feb. 7, 2011.

(56) References Cited

OTHER PUBLICATIONS

Written Opinion of the International Searching Authority for corresponding International application No. PCT/EP2010/068762, dated Feb. 7, 2011.
International Preliminary Report on Patentability for corresponding International application No. PCT/EP2010/068762, dated Nov. 17, 2011.
International Preliminary Report on Patentability for International Application No. PCT/EP2010/066376, dated Nov. 30, 2011.
Search Report for Danish Application No. PA 2009 70180, completed Jun. 3, 2010.

* cited by examiner

DOWNHOLE APPARATUS

RELATED APPLICATIONS

This application claims the benefit under 35 U.S.C. §371 of International Patent Application No. PCT/EP2010/066233, having an international filing date of Oct. 27, 2010, which claims priority to Danish Patent Application No. PA 2009 70180, filed Oct. 30, 2009, and U.S. Provisional Application No. 61/256,691, filed Oct. 30, 2009, the contents of all of which are incorporated herein by reference in their entirety.

FIELD OF THE INVENTION

The invention generally relates to an apparatus for operation in a drilled bore, e.g. of a hydrocarbon well.

BACKGROUND

In order to find and produce hydrocarbons e.g. petroleum oil or gas hydrocarbons such as paraffins, naphthenes, aromatics and asphaltics or gases such as methane, a well may be drilled in rock (or other) formations in the Earth.

After the well bore has been drilled in the earth formation, a well tubular may be introduced into the well. The well tubular covering the producing or injecting part of the earth formation is called the production liner. Tubulars used to ensure pressure and fluid integrity of the total well are called casing. Tubulars which bring the fluid in or from the earth formation are called tubing. The outside diameter of the liner is smaller than the inside diameter of the well bore covering the producing or injecting section of the well, providing thereby an annular space, or annulus, between the liner and the well bore, which consists of the earth formation. This annular space can be filled with cement preventing axial flow along the casing. However if fluids need to enter or leave the well, small holes will be made penetrating the wall of the casing and the cement in the annulus therewith allowing fluid and pressure communication between the earth formation and the well. The holes are called perforations. This design is known in the Oil and natural gas industry as a cased hole completion.

An alternative way to allow fluid access from and to the earth formation can be made, a so called open hole completion. This means that the well does not have an annulus filled with cement but still has a liner installed in the earth formation. The latter design is used to prevent the collapse of the bore hole. Yet another design is when the earth formation is deemed not to collapse with time, then the well does not have a casing covering the earth formation where fluids are produced from. When used in horizontal wells, an uncased reservoir section may be installed in the last drilled part of the well. The well designs discussed here can be applied to vertical, horizontal and or deviated well trajectories.

To produce hydrocarbons from an oil or natural gas well, a method of water-flooding may be utilized. In water-flooding, wells may be drilled in a pattern which alternates between injector and producer wells. Water is injected into the injector wells, whereby oil in the production zone is displaced into the adjacent producer wells.

A horizontal, open hole completion well can comprise a main bore or a main bore with wanted side tracks (fishbone well) or a main bore with unwanted/unknown side tracks.

Further, a horizontal, open hole completion well may, when producing hydrocarbons (producer well) or when being injected with water (injector well) be larger than the original drilled size due to wear and tear.

Additionally, horizontal, open hole completion wells can have wash outs and/or cave ins.

During the different phases of establishing a well in a formation of the earth and/or during subsequent carbohydrate production, a variety of downhole apparatus may permanently or temporarily be installed in the well.

Published international patent application WO 98/12418 discloses an elongate autonomous robot which is released downhole in an oil and/or gas production well by means of a launching module that is connected to a power and control unit at the surface. The elongated robot is equipped with sensors and arms and/or wheels which allow the robot to walk, roll or crawl up and down through a lower region of the well.

A downhole apparatus may thus comprise several sensors and/or electrical or hydro-mechanical components that produce sensor signals and/or require control signals as input. Furthermore, a downhole apparatus may comprise a plurality of movable parts that move relative to each other during operation.

Operation of a downhole apparatus is thus a complex operation and requires complex, fragile and expensive equipment. Recovery of a defective downhole apparatus may be a complicated and costly operation that also causes delays in the production of a hydrocarbon reservoir. It is thus generally desirable to allow efficient and reliable control of the relative movements of the movable parts and/or the electrical and/or hydro-mechanical components installed in a downhole apparatus and/or to allow efficient and reliable retrieval of sensor data in a downhole apparatus with a plurality of movable parts, even under difficult environmental operating conditions, such as under high pressure, e.g. at seabed, in areas with high levels of radiation, e.g. radioactive radiation, exposure to humidity, oil, mechanical impact and/or the like.

The spatial constraints of a downhole bore further limit the degrees of freedom for designing downhole apparatus that operate efficiently and reliably.

SUMMARY

Disclosed herein is a downhole apparatus for operation in a tubular channel, such as in a drilled bore e.g. of hydrocarbon well, the apparatus comprising a first part and a second part connected to the first part, wherein the second part comprises a first electronic device adapted to generate a data signal and a first communications device for wirelessly transmitting the generated data signal via a wireless communications channel, e.g. a radio-frequency or acoustic communications channel, wherein the first part comprises a second communications device for wirelessly receiving the transmitted data signal via said wireless communications channel.

Further disclosed herein are embodiments of a method for communicating data between a first part and a second part of an apparatus operating in a tubular channel, the second part of the apparatus being connected to the first part of the apparatus, the method comprising:

- generating a data signal by a first electronic device comprised in the second part;
- wirelessly transmitting the generated data signal from a first communications device comprised in the second part via a wireless communications channel to a second communications device comprised in the second part.

For the purpose of the present description, the communication between different parts of the apparatus will also be referred to as intra-tool communication, as it is communication internal to the apparatus. The use of a wireless communication for intra-tool communication, i.e. for communicating between different parts of the apparatus, provides a reliable communication that reduces the sensitivity to interference of electrical signals, defective connection of wires, etc. In particular, downhole apparatus are exposed to a harsh environment and need to operate reliably exposed to high pressure, humidity, oil, mechanical impact etc.

The use of wireless intra-tool communication further increases the degrees of freedom in terms of the design of the apparatus, as there is no need for providing wired communication lines between the different parts of the apparatus.

It is a further advantage of the apparatus and method described herein that the wireless signals can be transmitted across physical boundaries such as for example between compartments being at different pressure regimes or between compartments containing different fluids without the need for cumbersome and failure-prone wire penetration systems and sealing glands.

Embodiments of the apparatus may be a downhole apparatus for operation in a drilled bore, e.g. of a hydrocarbon well or another drilled bore in to the crust of the earth. The term drilled bore is intended to include injection wells. For the purpose of the present description, the term downhole apparatus is intended to refer to tools, equipment, instruments, or any other device used in a drilled bore of a hydrocarbon well underground and/or undersea.

Examples of such downhole apparatus include a tractor or a similar movable downhole device configured to be moved through a tubular channel such as a well in rock (or other) formations in the Earth, such as an open hole completion well. Other examples include a downhole controller, a downhole processing device such as an oil-water separator, a downhole power supply, auch as a power generator, or the like.

Embodiments of the apparatus disclosed herein may be open to the atmosphere but can also be sealed and pressure tight or pressure balanced when used at places where the pressure differs substantially from the 1 bar normally found on the face of the earth. Embodiments of the apparatus described herein may be a stand-alone device or may be an integral part of another device or assembly of devices.

The tubular channel may contain a fluid such as hydrocarbons, e.g. petroleum oil hydrocarbons such as paraffins, naphthenes, aromatics and asphaltics. Short range radio frequency communications links may be reliably operated in such an environment.

The internals of the apparatus disclosed herein include moving parts on or in which sensors or other communication modules are present which signals need to be continuously or cyclically transmitted to another part of the device which may moving or static. The use of wireless communications between different parts of an apparatus that are movably connected with each other avoids the risk of damaging connecting wires due to the numerous rotational and/or translational movements as well as interference or loss of electrical signals at movable contacts.

The data signal may be a sensor signal generated by a sensor installed in one of the parts of the apparatus and indicative of a measured property, a control signal for controlling a controllable function of one of the parts of the apparatus, or any other data signal to be communicated between different parts of an apparatus. The first electronic device may thus be a control unit, a sensor for measuring a physical property, and/or an electronic circuitry adapted to generate a data signal.

Examples of such a sensor may include a temperature sensor, a distance and/or displacement sensor, a pressure sensor, a flow rate measurement device, a measurement device for detecting the presence of and/or measurement of absolute and/or relative concentrations of one or more substances such as oil, water, gas, sand, $H_2S$, $CO_2$, etc., a vibration sensor, a sensor for measuring viscosity, density, resistivity, and/or the like, an acoustic sensor, an ultrasonic sensor, a near infrared sensor, a gamma ray detector, a position detecting device, a gyroscope, a compass, an accelerometer, a tilt meter, etc., or a combination thereof.

The first part may further comprise a second electronic device adapted to process the received data signal. The second electronic device may be a control unit, a data processing device, and/or an electronic circuitry adapted to process a data signal, or a combination thereof.

Similarly, the second electronic device may comprise a control unit for generating a control signal for controlling a controllable function of the apparatus, such as a relative movement of the second part relative to the first part and/or a controllable function of the second part, wherein the second communications device is further adapted to wirelessly transmit the control signal, wherein the first communications device is further adapted to receive the transmitted control signal, and wherein the second part comprises a control unit for controlling the controllable function of the second part.

Examples of a control unit include any circuit and/or device suitably adapted to control a controllable function of the apparatus. In particular, the above term comprises general- or special-purpose programmable microprocessors, Digital Signal Processors (DSP), Application Specific Integrated Circuits (ASIC), Programmable Logic Arrays (PLA), Field Programmable Gate Arrays (FPGA), special purpose electronic circuits, programmable logic controllers (PLC) etc., or a combination thereof.

The control of a controllable function may include the control of a device for performing a controllable function. Examples of such a device may include a valve, a motor, a sampling device, a device used in intelligent or smart well completion, an actuator, a lock, a release mechanism, a pump, etc.

Generally, a control unit may control a controllable function of the part in which the control unit is installed, e.g. responsive to a control signal and/or a data signal received from another part of the apparatus. Alternatively or additionally, a control unit may control a controllable function of another part of the downhole apparatus, different from the part in which the control unit is installed. To this end, the control unit may generate a control signal that is communicated to the other part via the wireless communications channel.

Embodiments of the apparatus disclosed herein may be made of metallic and/or non metallic components that may enclose the electronic device and/or the communications device and additional or alternative electric and/or electronic parts.

When the first and/or second parts include a respective metallic housing, e.g. made of steel such as stainless steel, or another suitable metal, and wherein the first and/or second communications device is/are arranged inside the respective metallic housings, the communications device is protected against physical impact, and the metallic housing may function as an antenna for radio frequency signals used in the intra-tool communication.

The wireless intra-tool communication may involve more than two communication modules comprised in the apparatus and forming a wireless radio or acoustic network using appropriate radio or acoustic frequencies. When the first and second communications devices are adapted to communicate with each other via a direct radio-frequency communications link or a communications link only including one or more relay communications devices comprised in the apparatus, the communication between the different parts is performed independently of any further equipment installed externally to the apparatus, e.g. in or around the tubular channel, and independently of the position of the apparatus.

The communications device may include any circuitry or device suitable for establishing data communication between the communications devices of the respective parts. The communication may be one-way or two-way communication. Accordingly, the first and second communications devices may each be adapted to both transmit and receive data signals. The first and second communications devices may be adapted to communicate with each other via a short-range radio-frequency communications channel, e.g. using a protocol according to the IEEE 802.11 or IEEE 802.15 standard, or another suitable industrial standard for wireless radio-frequency communication. Examples of suitable communications devices include radio-frequency receivers, transmitters, transceivers, Bluetooth transceivers, wireless network adapters, etc. Other examples include acoustic modems, and/or other devices enabling acoustic communications e.g. using ultrasonic signals which may use a binary protocol allowing acoustic communication, etc.

The connection between the first and the second part may be any suitable connection, e.g. by means of one or more connection members. The connection may be rigid, flexible, movable, a floating connection and/or the like, e.g. by means of a piston, rod, shaft, or any other suitable connecting member(s).

When the second part is movably connected to the first part, the use of wireless intra-tool communication is particularly useful, as any damage of wires as a result of the relative movement of the different parts of the apparatus is avoided.

Generally, it will be appreciated that a need exists to characterize open hole completion wells. The characterization may comprise e.g. measurement versus depth or time, or both, of one or more physical quantities in or around a well. In order to determine such characteristics of an open hole completion, wire-line logging may be utilized. Wire-line logging may comprise a tractor which is moved down the open hole completion during which data is logged e.g. by sensors on the tractor.

An open hole completion may comprise soft and/or poorly consolidated formations which may pose a problem for some tractor technologies. For example, chain tracked tractors may impact the wall of soft and/or poorly consolidated formations with too large a force, and tractors comprising gripping mechanisms may rip of pieces of the soft and/or poorly open hole completion wall. A further problem of tractors comprising gripping mechanisms is the restriction in outer diameter, due to the drilled well, of the tractor which may restrict the length and mechanical properties of the gripping mechanisms A further problem of some tractor technologies with respect to e.g. horizontal open hole completion wells is that the open hole completion may have a diameter varying from the nominal inner diameter of 8.5 inch of the cased completion hole due to e.g. wash-outs and/or cave ins.

Thus, it may be advantageous to be able to move a tractor through an open hole completion well possibly containing soft and/or poorly consolidated formations.

In some embodiments, the apparatus disclosed herein is adapted to be moved along a tubular channel, and the apparatus may comprise two gripping means fluidly connected via a pump; wherein a first of the two gripping means comprises a fluid; wherein the pump is adapted to inflate a second of the gripping means by pumping the fluid from the first of the two gripping means to the second of the two gripping means; and wherein the gripping means comprises a flexible member contained in a woven member, wherein the flexible member provides fluid-tightness and the woven member provides the shape of the gripping means.

The gripping means comprising a flexible member contained in a woven member, which may be inflated, enables the device to exert a force to the wall of a tubular channel without ripping pieces of the wall.

Additionally, the woven member may provide a shape of the flexible member, so that the flexible member may not be over-stressed and/or deformed beyond it's allowable elastic range. Further, the woven member provides physical strength and wear resistance to the flexible member.

In some embodiments, the first gripping means are attached to the first part of the apparatus, and the second gripping means are attached to the second part of the apparatus; wherein the first part comprises a reservoir comprising a fluid and sealed from a pressure chamber comprising a fluid and a piston dividing the pressure chamber into a first and a second piston pressure chamber fluidly coupled via a pump; and wherein the second part is attached to the first part via a hollow tubular member extending from the reservoir through the pressure chamber; and wherein the hollow tubular member is attached to the piston such that translation of the piston via a pressure difference between the first (B) and a second piston pressure chamber (C) established by the pump results in translation of the hollow tubular member and the second part.

Thereby, the device is able to move forward in the tubular channel without restricting the length and mechanical properties of the gripping means because the translation is performed along the longitudinal axis of the device and the gripping means are flexible. Furthermore, due to the use of wireless intra-tool communication, the translation is not impaired by any wired connections.

In some embodiments, inflation of the second gripping means attached to the second part is performed by pumping the fluid from the first gripping means via the reservoir and the hollow tubular member to the second gripping means.

By inflating the second gripping means via a the reservoir and the hollow tubular member, the apparatus may push the second part and pull the first part without risking breaking electrical wires, pipes or the like establishing fluid coupling between the pump and the second gripping means and/or electrical connection between the first and the second parts.

In some embodiments, the device further comprises a pressure relief valve fluidly coupled to the pump to determine a maximal pressure pumped into the gripping means. Thereby, the device is able to control the maximal pressure exerted on the walls of the open hole completion and therewith prevent damage to the walls because the pressure relief valve may be set to open before a pressure is reached at which damage to the walls is likely to occur.

In some embodiments, the second electronic device comprises a control unit such as a PLC; the first electronic device comprises at least one sensor communicatively coupled via the first and second communications devices and the wireless communications channel to the control unit, and the control unit is adapted to generate a control signal for controlling the pump based on data from the at least one sensor. Thereby, embodiments of the apparatus are able to adjust the pressure pumped into the gripping means according to the surroundings in the tubular channel, because the control unit may adjust the pressure pumped into the gripping means according to the surrounding e.g. if the tubular channel narrows due to a cave-in, the control unit may reduce the pressure pumped into the gripping means at the location of the cave-in. Alternatively or additionally, the control unit may adjust the translation-length of the second part such that placement of a gripping means at the cave-in is avoided and thus that the gripping means are placed on either side of the cave-in.

It may generally be desirable to be able to identify water bearing fractures without cementing a liner into an open hole completion and without having to convey petrophysical logging tools into horizontal wells by conventional means.

U.S. Pat. No. 6,241,028 disclose a method and system for measuring data in a fluid transportation conduit, such as a well for the production of oil and/or gas. The system employs one or more miniature sensing devices which comprise sensing equipment that is contained in a preferably spherical nut-shell.

However, horizontal wells need not be straight. Further, wells may contain obstructions such as wash-outs and/or well side tracks, e.g. in fishbone wells, which may prevent the above system from examining the entire well.

Thus, it may be advantageous to be able to examine wells comprising obstructions such as wash-outs and/or side tracks and/or to be able to examine non-straight horizontal wells.

In some embodiments, the apparatus comprises a three-way valve, buoyancy means, pressure means, a vent line, at least one sensor and computation means; wherein the three-way valve controls the fluid flow between the pressure means and the buoyancy means and between the buoyancy means and the vent line; the computation means is communicatively coupled, via the wireless communications channel, to the at least one sensor and adapted to generate a control signal based on data received from the at least one sensor; and wherein the pressure means is fluidly coupled to the buoyancy means via the three-way valve such that a fluid may flow from the pressure means to the buoyancy means or from the buoyancy means to the surroundings of the device via the vent line; and wherein the computation means is communicatively coupled, via the wireless communications channel, to the three-way valve and controls said three-way valve via the control signal.

Thereby, the device may be prevented from getting stuck in a wash-out, e.g. in the bottom of a tubular channel or in the top of a tubular channel because via the at least one sensor, the device is able to detect the wash-out and calculate a control signal indicating how much fluid the three way valve is to let into the buoyancy means. Thereby, the device is able to dive below or above the wash-out Further, the device may be prevented from navigating into a wrong tubular channel e.g. an unintended side track or leg of a fishbone well, by first detecting the tracks in front of the device and subsequently changing the buoyancy of the device accordingly.

The different aspects of the present invention can be implemented in different ways including the apparatus and the method described above and in the following and further systems and/or product means, each yielding one or more of the benefits and advantages described in connection with at least one of the aspects described above, and each having one or more preferred embodiments corresponding to the preferred embodiments described in connection with at least one of the aspects described above and/or disclosed in the dependant claims. Furthermore, it will be appreciated that embodiments described in connection with one of the aspects described herein may equally be applied to the other aspects. For example, one aspect of the present invention relates to a communications system for use in a downhole apparatus as described herein, the system comprising first and second communications devices to be placed in respective parts of a downhole apparatus and adapted to wirelessly communicate with each other as described herein.

Further embodiments and advantages are disclosed below in the description and in the claims.

BRIEF DESCRIPTION OF THE DRAWINGS

The invention will now be described more fully below with reference to the drawings, in which.

DETAILED DESCRIPTION

Various aspects related to and embodiments of an apparatus disclosed herein will now be described with reference to the drawings showing examples of an apparatus for operation in a tubular channel, such as a downhole apparatus. However, the invention may be applied to other types of apparatus.

Figure 1:
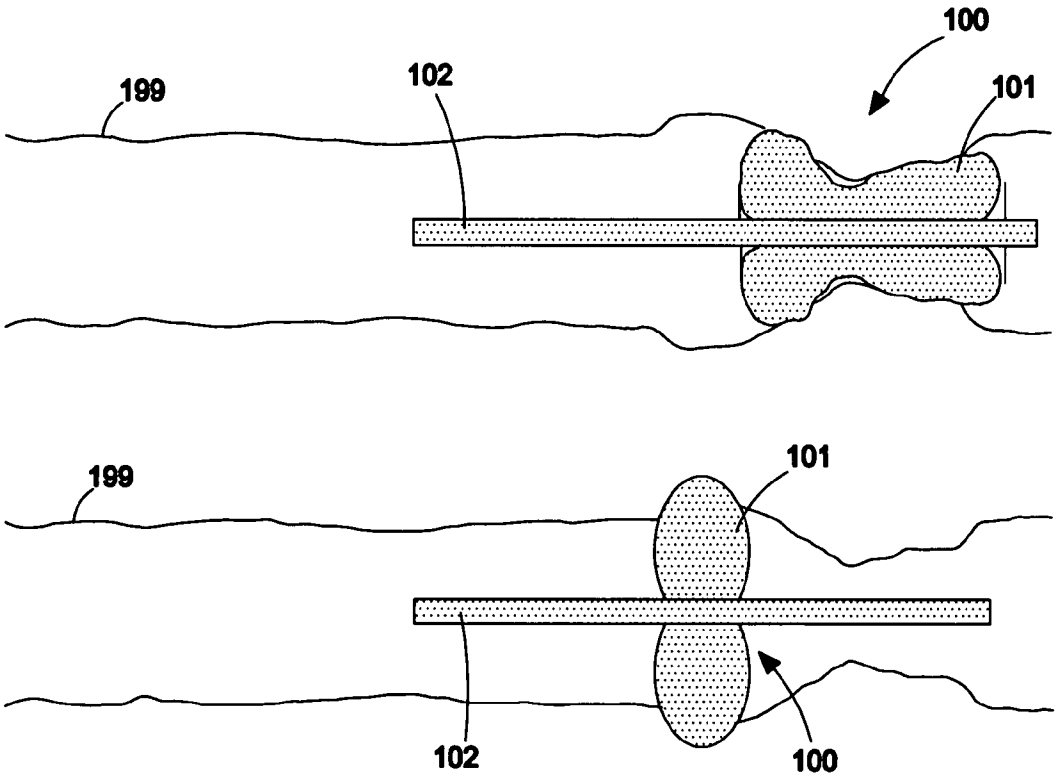
FIG. 1 shows a sectional view of a device 100 for moving in a tubular channel 199.

FIG. 1 shows a sectional view of a device 100 for moving in a tubular channel 199, such as a borehole, a pipe, a fluid-filled conduit, and an oil-pipe. The tubular channel 199 may contain a fluid such as hydrocarbons, e.g. petroleum oil hydrocarbons such as paraffins, naphthenes, aromatics and asphaltics.

The device 100 comprises inflatable and deflatable gripping means 101. The inflatable and deflatable gripping means 101 may, for example, be flexible bellows which may adapt to the wall condition of the tubular channel 199. The gripping force exerted by the device 100 on the tubular channel wall 199 depends on the pressure of the flexible bellows 101 on the tubular channel wall 199. The device 100 further comprises a part 102 to which the inflatable and deflatable gripping means 101 may be fastened and which may be at least partially encased by the inflatable and deflatable gripping means 101. For example, the part 102 may be rod-shaped and the inflatable and deflatable gripping means 101 may be shaped as a tubeless tire and thus, when fastened to the rod-shaped part 102 e.g. via glue or the like, encase a part of the rod-shaped part 102.

Figure 2:
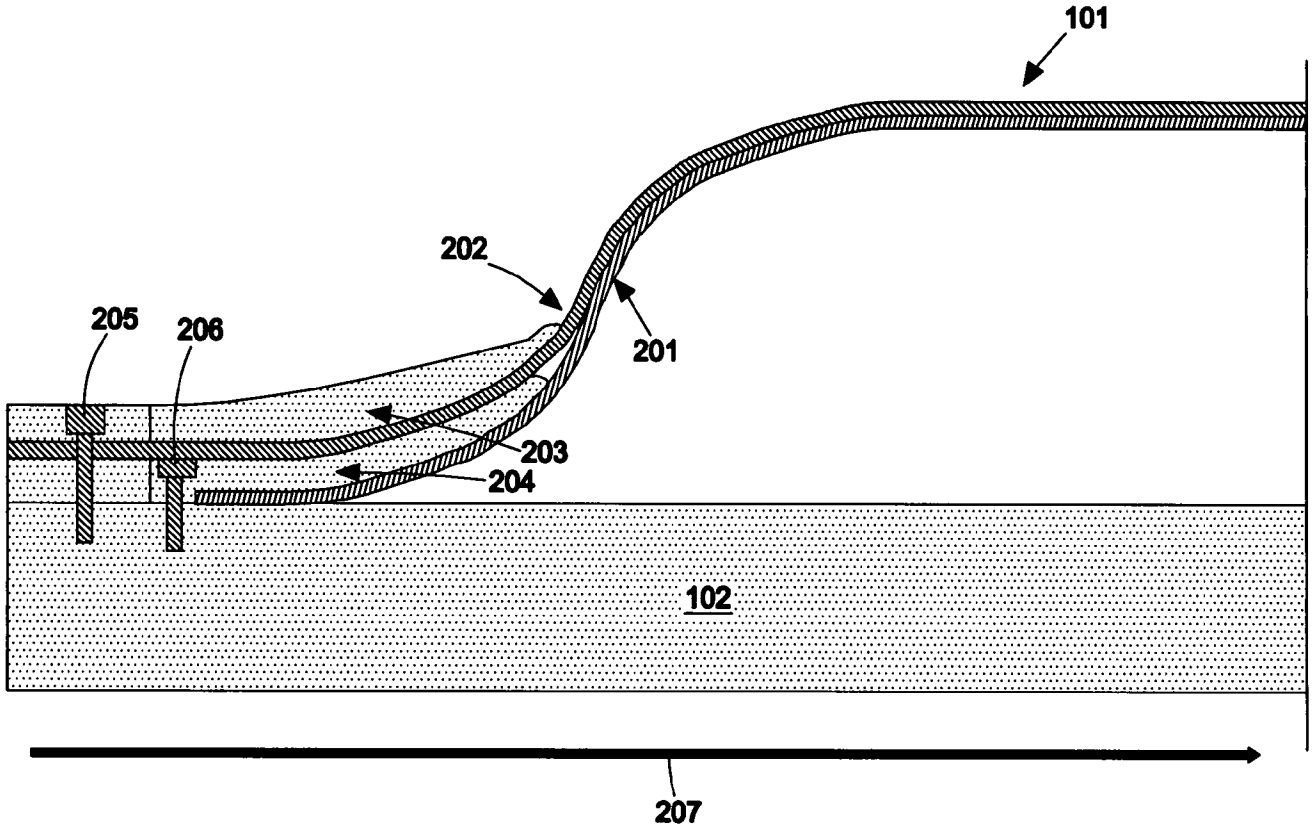
FIG. 2 shows a sectional view of a inflatable and deflatable gripping means 101.

FIG. 2 shows a sectional view of the inflatable and deflatable gripping means 101. The flexible bellows 101 may comprise a woven texture bellow 202, e.g. made of woven aramid and/or Kevlar, and a pressure-tight flexible bellow 201, e.g. made of a rubber or other flexible and air-tight/pressure-tight/fluid-tight material. The pressure-tight flexible bellow 201 is encased by the woven texture 202. The flexible pressure-tight bellow 201 provides the pressure integrity of the inflatable and deflatable gripping means 101.

The pressure-tight flexible bellow 201 may be clamped to the part 102 by a first curved, e.g. parabolic-shaped, ring 204 providing a gradual clamping force along the horizontal axis 207 of the part 102, whereby pinching and subsequent rupture of the pressure-tight flexible bellow 201 due to an internal pressure of the pressure-tight flexible bellow 201 may be prevented. The first curved ring 204 may be clamped to the part 102 by a fastening means 206 such as a screw, nail or the like. The first curved ring 204 is pressure tight, i.e. it provides sealing of the pressure-tight flexible bellow 201 to the part 102 but may have any clamping strength.

The woven texture bellow 202 may be clamped between the first curved ring 204 and a second curved, e.g. parabolic-shaped, ring 203. The first and the second curved rings thus provide a gradual clamping force along the horizontal axis 207 of the part 102, whereby pinching and wear of the woven texture bellow 202 may be prevented. The second curved ring 203 may be clamped to the part 102 by a fastening means 205 such as a screw, nail or the like. The second curved ring 203 may be positioned on top of the first curved ring 204 as illustrated in FIG. 2. The second curved ring 202 must be strong in order to maintain the shape of the woven texture, but may provide any pressure tightness i.e. it is not required to be pressure-tight.

The woven texture bellow 202 may provide a shape of the pressure-tight flexible bellow 201, so that the pressure-tight flexible bellow 201 may not be over-stressed and/or deformed beyond it's allowable elastic range. Further, the woven texture bellow 202 provides physical strength and wear resistance to the pressure-tight flexible bellow 201.

The curved rings may further provide shape stability of the inflatable and deflatable gripping means 101. Further, the curved rings may prohibit sharp edges such that multiple inflations/deflations of the inflatable and deflatable gripping means 101 can be achieved.

In an embodiment, the woven texture 202 may be covered with ceramic particles in order to provide wear resistance of the woven texture 202.

Figure 3:
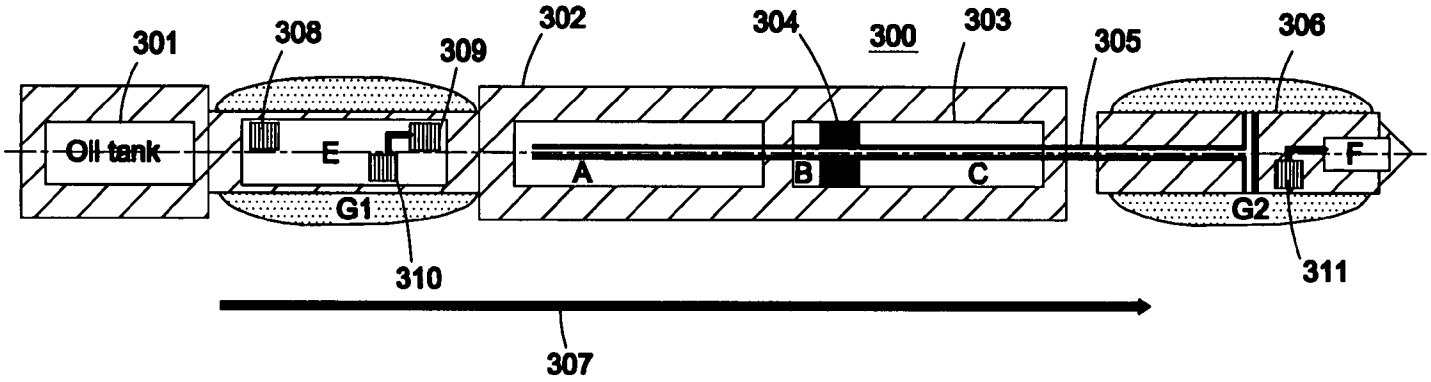
FIG. 3 shows a sectional view of an embodiment of a device 100 for moving in a tubular channel 199 comprising two inflatable and deflatable gripping means, G1, G2.

FIG. 3 shows a sectional view of an embodiment of a device 100 for moving in a tubular channel 199. The device comprises two parts, a pump section E and a sensor section 306, each comprising a respective one of two inflatable and deflatable gripping means, G1, G2. The device 100 comprises a hydrophore 301 attached to the pump section E. The pump section E comprises a pumping unit 308 and a programmable logic controller (PLC) 309 or another suitable type of control unit.

The hydrophore 301 may, for example, be a rubber bellow encased or substantially encased in a steel cylinder. The hydrophore 301 may contain oil (or any other pumpable fluid). The hydrophore prevents the oil from bursting out e.g. when the pressure changes and/or when the temperature changes. For example, the temperature at the entrance of the tubular channel 199 may be at −10 degrees C. and in the tubular channel 199 the temperature may be 100 degrees C. Additionally for example, the pressure at the entrance of the tubular channel 199 may be 1 bar and in the tubular channel 199 the pressure may be 250 bar.

The pump section E may further comprise a battery providing power to the device 100. Alternatively or additionally, the device 100 may comprise a plug/socket for receiving a wireline, through which the device 100 may be powered. For example, the plug/socket may be located on the oil tank 301 e.g. on the end facing away from the pump section E.

The pumping unit 308 may, for example, comprise a fixed displacement bidirectional hydraulic pump.

The PLC 309 is communicatively coupled, e.g. via an electric wire, to a short-range radio unit 310 included in the pump section E, such as a radio receiver or transceiver operating on a suitable radio-frequency band and using a suitable communications protocol. Examples of suitable protocols include the industry communication protocols standardized as EEE standards such as the 802.11 (known as WiFi, WiMAX HiperLAN) or the 802.15 (known as Bluetooth, Zigbee, EnOcean) for radio communication.

Further attached to and partly or wholly encasing the pump section E is a first inflatable and deflatable gripping means G1. The first inflatable and deflatable gripping means G1 may be of the type disclosed under FIG. 2. The first inflatable and deflatable gripping means G1 may comprise a fluid such as an oil or the like which may be pumped by the pumping unit 308.

Further attached to the pump section E is a cylinder section 302. The cylinder section 302 comprises a reservoir A, e.g. an oil reservoir, and a pressure chamber 303 comprising a first piston pressure chamber B and a second piston pressure chamber C.

The cylinder section 302 further comprises a piston 304 attached to a connecting rod 305. A first end of the connecting rod 305 is located in the oil reservoir A and the other end of the connecting rod 305 is attached to a sensor section 306. The sensor section 306 is thus movably attached to the device 100 via the connection rod 305. The connection rod 305 may translate along the longitudinal axis 307 of the device 100. The connecting rod 305 may be hollow i.e. enabling e.g. a fluid to pass through it. The piston 304 is located in the pressure chamber 303.

The oil reservoir and the first piston pressure chamber B and the second piston pressure chamber C may comprise a pumpable fluid, such as an oil or the like, which may be pumped by the pumping unit 308. The oil reservoir A may be sealed from the pressure chamber 303.

Attached to and partly or wholly encasing the sensor section 306 is a second inflatable and deflatable gripping means G2. The second inflatable and deflatable gripping means G2 may be of the type disclosed under FIG. 2. The second inflatable and deflatable gripping means G2 may comprise a fluid such as an oil or the like which may be pumped by the pumping unit 308.

Further, the sensor section 306 comprises one or more sensors F. For example, the sensor section 306 may contain a number of ultrasonic sensors for determining the relative fluid velocity around the sensor section 306. An ultrasonic sensor may be represented by a transducer. The ultrasonic sensors may be contained within the sensor section 306. The ultrasonic sensors may provide data representing a fluid velocity.

Additionally or alternatively, the sensor section 306 may, for example, include a number of distance sensors. The number of ultrasonic distance sensors may provide data representing a distance to e.g. the surrounding tubular channel 199. The ultrasonic distance sensors may be contained within the sensor section 306. The ultrasonic distance sensors may provide data representing a distance between the sensor section 306 and the surrounding tubular channel 199 i.e. data representing a radial view. Further, the ultrasonic distance sensors may provide data representing a distance between the sensor section 306 and e.g. potential obstacles, such as cave-ins/wash-outs, in front of the device 100 i.e. data representing a forward view.

The ultrasonic sensors and ultrasonic distance sensors of the sensor section 306 may be probing the fluid surrounding the device 100 and the tubular channel 199 through e.g. glass windows such that the sensors are protected against the fluid flowing in the tubular channel 199.

Additionally or alternatively, the sensor section 306 may comprise a pressure sensor. The pressure sensor may be contained in the sensor section 306.

The pressure sensor may provide data representing a pressure of a fluid surrounding the device 100.

Further, the sensor section 306 may contain an resistivity meter for measuring the resistivity of the fluid surrounding the device 100. The resistivity meter may be contained in the sensor section 306. The resistivity meter may provide data representing resistivity of the fluid surrounding the device 100.

Further, the sensor section 306 may contain a temperature sensor for measuring the temperature of the fluid surrounding the device 100. The temperature sensor may be contained in the sensor section 306. The temperature sensor may provide data representing a temperature of the fluid surrounding the device 100.

Additionally or alternatively, the sensor section 306 may comprise a position-determining unit providing data representing the position of the device 100, and thus enabling position tagging of the data from the above-mentioned sensors. The position tagging may, for example, be performed with respect to e.g. the entrance of the tubular channel 199.

In an embodiment, the position-determining unit may comprise a plurality of gyroscopes, for example three gyroscopes (one for each three dimensional axis), and a compass and a plurality of accelerometer G-forces, for example three accelerometers (one for each three dimensional axis), and a tiltmeter (inclinometer).

The sensor section 306 further comprises a short-range radio unit 311, such as a transmitter or a transceiver corresponding to the short-range radio unit 310 of the pump section, and adapted to establish a short-range radio link to the short-range radio unit 310 of the pump section. Further, the short-range radio unit 311 may be communicatively coupled, e.g. via an electric wire, to one or more of the abovementioned sensors and thereby the sensor section 306 is enabled to transmit data from the one or more sensors F to the PLC 309 via the short-range radio link. The use of wireless radio communication between the sensor section and the pump section avoids the need for wires that can adapt to the varying distance between the two sections. Furthermore, the radio signals can be reliably transmitted through the oil filled gripping means G1 and G2 surrounding the respective sections.

The PLC 309 may be communicatively coupled, e.g. via electric wires, to the pumping unit 308 whereby the PLC is able to control the pumping unit 308 e.g. by transmitting a control signal to the pump 400 of the pumping unit 308.

Figure 4:
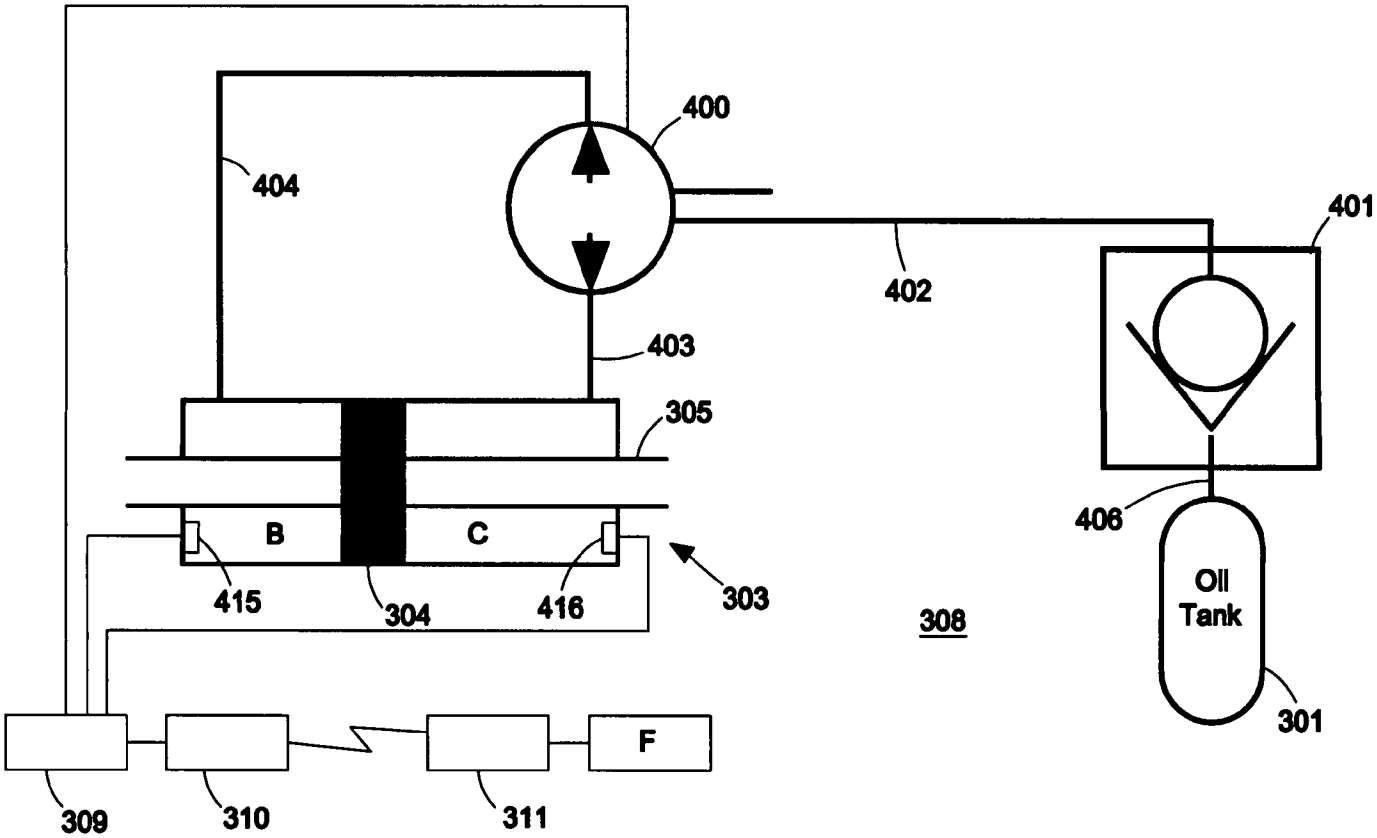
FIG. 4 shows a schematic diagram of an embodiment of a pumping unit 308 adapted to translate the connecting rod 305.

FIG. 4 shows a schematic diagram of an embodiment of a pumping unit 308 adapted to translate the connecting rod 305, and a corresponding control circuit. The pumping unit of FIG. 4 may be contained in a device such as disclosed with respect to FIGS. 3 and/or 6 and/or 8.

The pumping unit 308 comprises the pump 400 of the pump section E. Further, the pumping unit 308 comprises a back-flow valve 401 and the oil tank 301. The pump 400, e.g. a low pressure pump, is fluidly coupled, e.g. via a pipe 402, to the back-flow valve 401, and via the valve 401 and a pipe 402 to the oil tank 301. Additionally, the pump 400 is fluidly coupled, e.g. via a pipe 403, to the second piston pressure chamber C and, e.g. via a pipe 404, to the first piston pressure chamber B of the pressure chamber 303.

The pumping unit 308 is able to, e.g. in response to a control signal from the PLC 309, translate the piston 304 and thereby the connecting rod 305 along the longitudinal axis 307 of the device 100.

For example, to translate the piston 304 towards the first piston pressure chamber B i.e. to the left in FIG. 4, the PLC 309 may transmit a control signal to the pump 400 such that the pump 400 starts to pump the fluid from the first piston pressure chamber B to the second piston pressure chamber C via the pipe 404. Thereby, the first piston pressure chamber B is depressurized and the second piston pressure chamber C is pressurized and thereby, the piston moves towards the first piston pressure chamber B.

For example, to translate the piston 304 towards the second piston pressure chamber C i.e. to the right in FIG. 4, the PLC 309 may transmit a control signal to the pump 400 such that the pump 400 starts to pump the fluid from the second piston pressure chamber C to the first piston pressure chamber B via the pipe 404. Thereby, the second piston pressure chamber C is depressurized and the first piston pressure chamber B is pressurized and thereby, the piston moves towards the second piston pressure chamber C.

The PLC 309 may transmit a further control signal to the pump 400 in order to stop the pump 400 when the piston 304, and thereby also the connecting rod 305, has been translated a distance determined by the PLC based on the data received from the one or more sensors via the wireless communications link between radio units 310 and 311. Alternatively or additionally, the pump 400 may receive a stop signal from the PLC 309 when the piston 304 reaches an end wall of the pressure chamber 303 e.g. by having switch 415 and 416, respectively, e.g. pushbutton switches, attached to the inside of each of the end walls of the pressure chamber 303 detecting when the piston 304 touches one of the end walls. The switches may be communicatively coupled, e.g. via electric wires, to the PLC 309.

Figure 5:
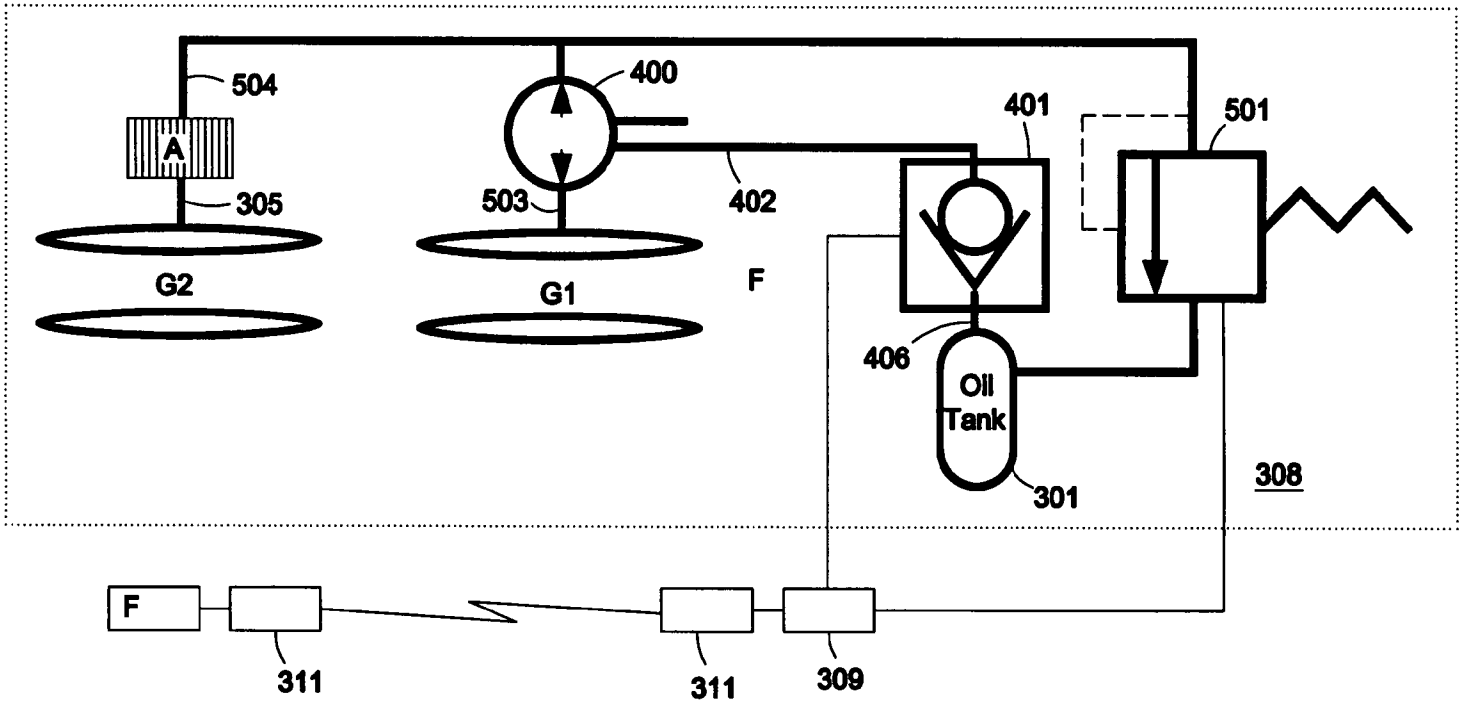
FIG. 5 shows a schematic diagram of an embodiment of a pumping unit 308 adapted to inflate and/or deflate the first and second inflatable and deflatable gripping means G1, G2.

FIG. 5 shows a schematic diagram of an embodiment of a pumping unit 308 adapted to inflate and/or deflate the first and second inflatable and deflatable gripping means G1, G2, and a corresponding control circuit. The pumping unit of FIG. 5 may be contained in a device such as disclosed with respect to FIGS. 3 and/or 6 and/or 8.

The pumping unit 308 comprises the pump 400 of the pump section E. Further, the pumping unit 308 comprises the back-flow valve 401 and the oil tank 301. Further, the pumping unit 308 may comprise a pressure-relief valve 501, the oil reservoir, the connecting rod 305 and the first and second inflatable and deflatable gripping means G1, G2.

The pressure-relief valve 501 may, for example, determine the pressure in the pumping unit 308.

The pump 400, e.g. a low pressure pump, is fluidly coupled, e.g. via a pipe 402, to the back-flow valve 401, and via the valve 401 and a pipe 406 to the oil tank 301.

Additionally, the pump 400 is fluidly coupled, e.g. via a pipe 503, to the first inflatable and deflatable gripping means G1 and, e.g. via a pipe 504, to the second inflatable and deflatable gripping means G2. The pipe 504 may further fluidly couple the pump 400 to the pressure-relief valve 501. The pressure-relief valve 501 may be fluidly coupled via e.g. a pipe 505 to the oil tank 301.

In response to a control signal from the PLC 309, the pumping unit 308 is adapted to inflate one of the inflatable and deflatable gripping means while deflating the other. Hence, the PLC controls the operation of the gripping means g1 and G2, optionally including controlling the degree of displacement of the piston responsive to the sensor signals received from the sensor(s) F via radio units 310 and 311.

For example, to inflate the first inflatable and deflatable gripping means G1, the PLC 309 may transmit a control signal to the pump 400 such that the pump 400 starts to pump the fluid from second inflatable and deflatable gripping means G2 to the first inflatable and deflatable gripping means G1 via the connecting rod 305, the oil reservoir A and the pipe 504. Thereby, the second inflatable and deflatable gripping means G2 deflates while the first inflatable and deflatable gripping means G1 inflates.

For example, to inflate the second inflatable and deflatable gripping means G2, the PLC 309 may transmit a control signal to the pump 400 such that the pump 400 starts to pump the fluid from first inflatable and deflatable gripping means G1 to the second inflatable and deflatable gripping means G2 via the pipe 504, the oil reservoir A and the connecting rod 305. Thereby, the first inflatable and deflatable gripping means G1 deflates while the second inflatable and deflatable gripping means G2 inflates.

The PLC 309 may transmit a further control signal to the pump 400 in order to stop the pump 400 when the inflatable and deflatable gripping means being inflated has a volume providing a sufficient grip on the tubular channel wall. The sufficient grip on the tubular channel may, for example, be determined by the pressure relief valve 501 i.e. as long as the valve is close, the pump 400 pumps from one inflatable and deflatable gripping means to the other inflatable and deflatable gripping means. Once the pressure-relief valve 501 opens, the pump pumps from the deflating inflatable and deflatable gripping means to the oil tank via the pressure relief valve 501.

The pressure relief valve 501 may be communicatively coupled to the PLC 309 e.g. via a wire. Once the pressure relief valve 501 opens, it may transmit a control signal to the PLC 309 which subsequently transmits a control signal to the pump 400 stopping the pump 400. Once the pressure in the pumping unit 500 reaches the pressure relief valve's reseating pressure, the pressure relief valve closes again.

Figure 6:
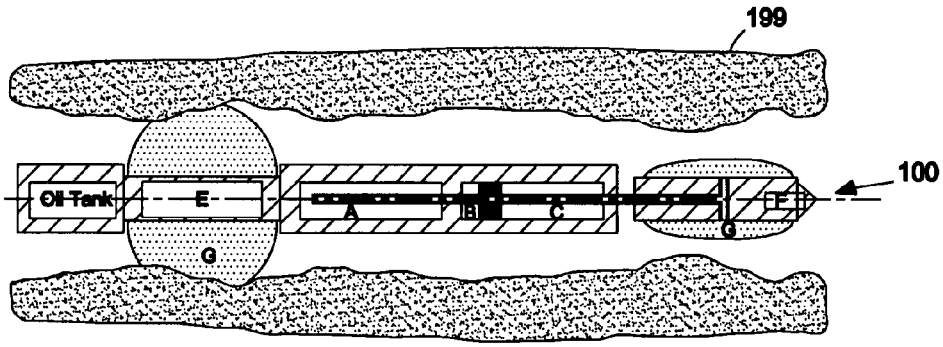
FIG. 6 shows a method of moving the device 100 in a tubular channel 199.
Figure 6:
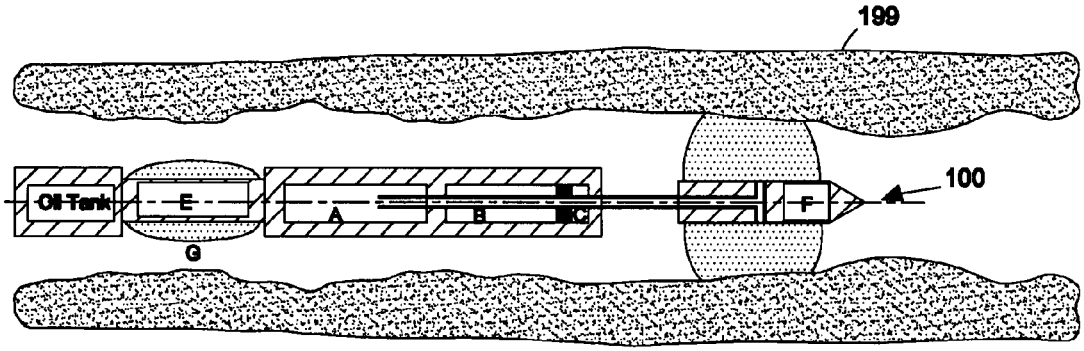
Figure 6:
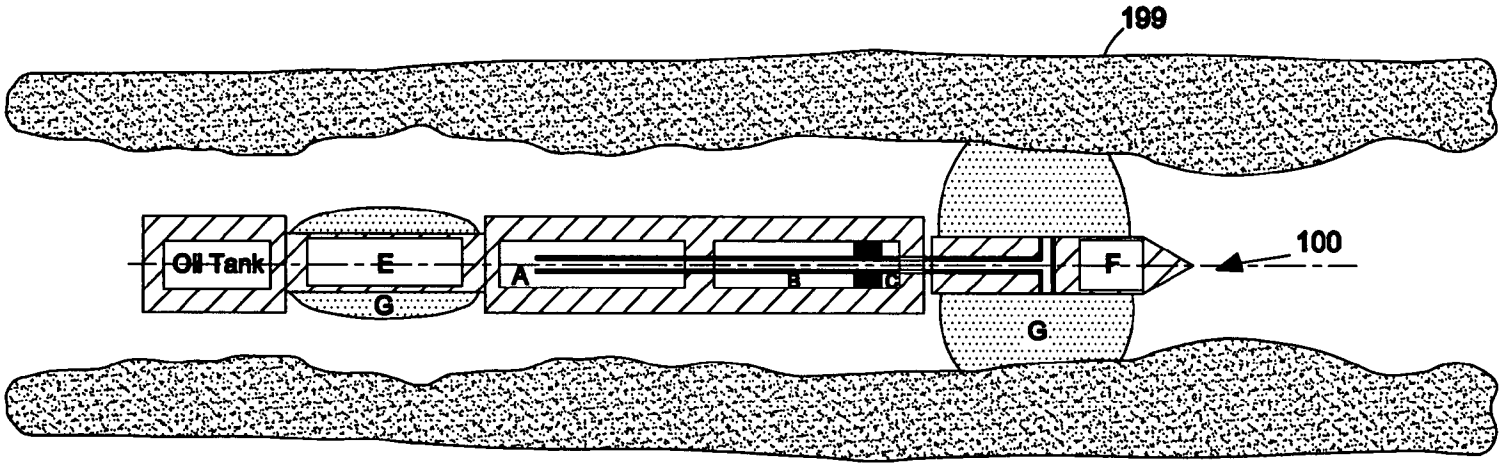
Figure 6:
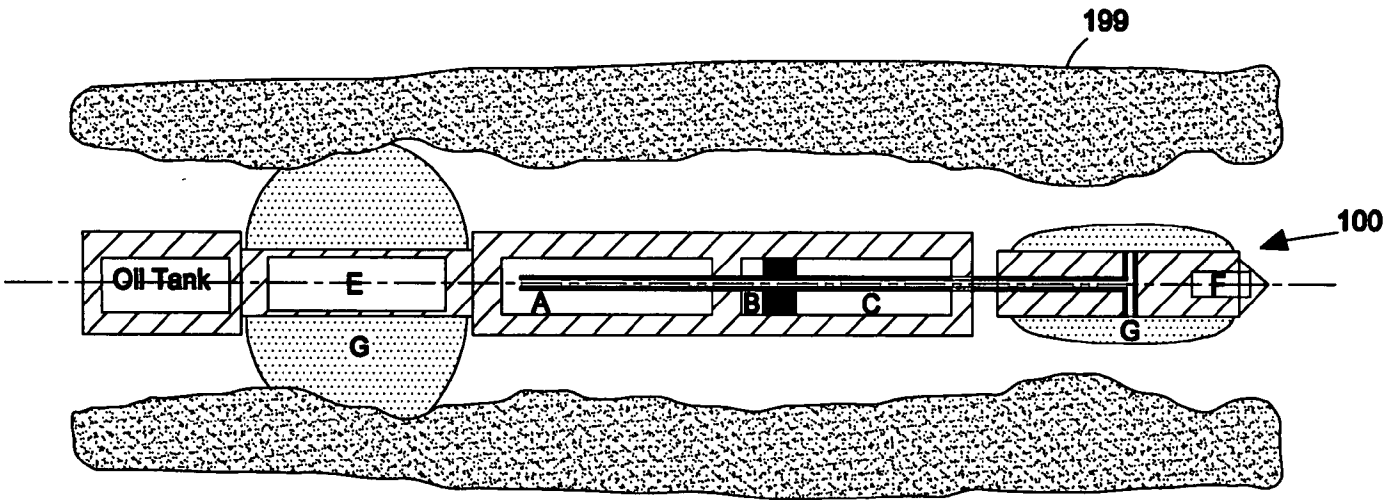

FIG. 6 shows a method of moving the device 100 in a tubular channel 199.

Figure 7:
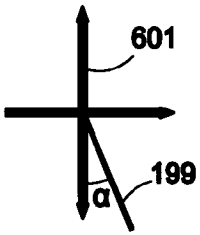
FIG. 7 shows the angle between the tubular channel and vertical.

In a first step, the device 100, e.g. containing a load such as a patch or the like, may be moved into the tubular channel by a wireline lubricator. The device 100 may be moved in such a way as long as the angle $\alpha$, as shown in FIG. 7, between the tubular channel 199 and vertical 601 is smaller than 60 degrees. When the angle $\alpha$ becomes equal to or larger than 60 degrees, the friction between the device 100 and the tubular channel 199 and/or the fluid in the tubular channel 199 may be larger than the gravitational pull in the device 100 thus preventing the device 100 from moving further in this way.

When moving the device 100 via a wireline lubricator, both the first and the second inflatable and deflatable gripping means G1, G2 may be deflated in order to ease movement of the device 100 through the tubular channel 199.

Thus, in a second step, the device is powered up comprising starting the sensors F in the sensor section 306. The power-up may further comprise a test of all the sensors and communication between the short-range radio units 310 and 311.

In a third step as illustrated in FIG. 6A), the first inflatable and deflatable gripping means G1 are inflated. In the case where the device 100 has just powered up, both inflatable and deflatable gripping means G1, G2 are deflated and therefore, the inflation is performed by pumping fluid from the oil tank 301 via pipe 406, back flow valve 401, pipe pump 308, and pipe 503 into inflatable and deflatable gripping means G1.

In a fourth step, the sensor section 306 is translated (pushed) to the right by pressurizing the first piston pressure chamber B and depressurizing the second piston pressure chamber C as disclosed above with respect to FIG. 4.

In a fifth step as illustrated in FIG. 6B), the second inflatable and deflatable gripping means G2 are inflated and the first inflatable and deflatable gripping means G1 are deflated as disclosed above with respect to FIG. 5.

In a sixth step as illustrated in FIG. 6C), the oil tank 301, the pump section E and the cylinder section 302 are translated (pulled) to the right by pressurizing the second piston pressure chamber C and depressurizing the first piston pressure chamber B as disclosed above with respect to FIG. 4.

In a seventh step as illustrated in FIG. 6D), the first inflatable and deflatable gripping means G1 are inflated and the second inflatable and deflatable gripping means G2 are deflated as disclosed above with respect to FIG. 5.

The above steps, step seven, step four, step five and step six, provides a method of moving the device 100 in a tubular channel 199 once one of the inflatable and deflatable gripping means G1, G2 have been inflated.

In an embodiment, the device 100 may move in reverse of the above described direction. In the event where the device 100 is powered through and/or connected to a wireline, the wireline must be pulled out of the tubular channel 199 at the same velocity or approximately the same velocity (e.g. withing 1%) as the device 100 moves through the tubular channel 199.

In an embodiment, the hydrophore 301, the pump section E, the cylinder section 302 and the sensor section may have a cylindrical cross section. For example, the device 100 with deflated inflatable and deflatable gripping means G1, G2 may have a diameter of approximately 4 inches (approximately 101.6 mm).

In an embodiment, based on the data received by the PLC 309 from the sensor section 306, e.g. from the ultrasonic distance sensors, the PLC 309 may determine by calculation whether the tubular channel 199 in front of the device 100 allows for moving the device 100 further into the tubular channel 199. Alternatively or additionally, based on the data received by the PLC 309 from the sensor section 306, e.g. from the ultrasonic distance sensors, the PLC 309 may determine the direction in which the device 100 is moving e.g. in the case of side tracks or the like in the tubular channel 199. Thereby, the PLC may calculate a control signal for controlling the device 100 based on the data received from one or more of the sensors F.

In an embodiment, the device 100 may further comprise an acoustic modem enabling the device 100 to transmit data received from one or more of the sensors F to a computer or the like equipped with an acoustic modem and positioned at the entrance of the tubular channel 199.

In an embodiment, the device 100 comprises two pumps, one for the pumping unit of FIG. 4 and one for the pumping unit of FIG. 5. Alternatively, the device 100 may comprise a single pump which through valves serves the pumping unit of FIG. 4 and the pumping unit of FIG. 5.

Figure 8:
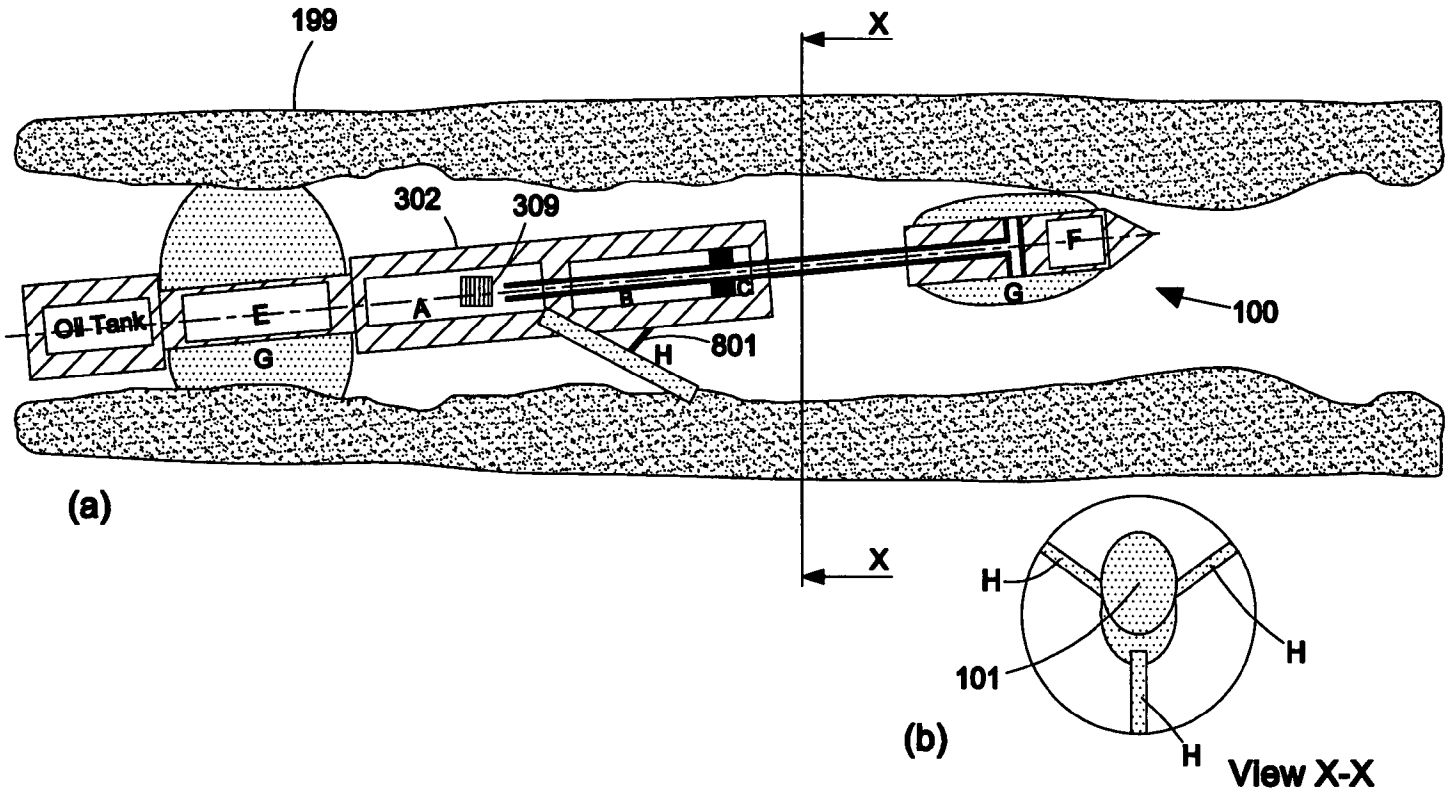
FIG. 8 shows a sectional view of an embodiment of a device for moving in a tubular channel comprising directional means.

FIG. 8 shows a sectional view of an embodiment of a device 100 for moving in a tubular channel 199 comprising directional means H. The device 100 may comprise the technical features disclosed with respect to FIGS. 2 and/or 3 and/or 4 and/or 5. The directional means H may enable a steering of the device 100 e.g. a change in orientation of the device 100 with respect to a longitudinal axis of the tubular channel 199 e.g. in order to move the device into a sidetrack of a fishbone well or the like.

As seen in FIG. 8*a*), the directional means H may, for example, comprise a cylindrical element e.g. a rod or the like. A first end of the cylindrical element may be attached to the cylinder section 302 via a ball bearing or a ball joint or a hinge or the like. The cylindrical element may act as a lever and may be connected to an actuator 801 which may extend the other end of the lever in a direction radially outwards from the cylinder section 302. The length of the directional means H may, for example, be approximately equal to the diameter of the tubular channel 199 e.g. approximately 8.5 inch±5%.

The actuator 801 may be electrically coupled, e.g. via an electric wire or via a second wireless radio-frequency communications link, to the PLC 309 enabling activation of the actuator via a control signal from the PLC 309.

In an embodiment as seen in FIG. 8*b*), the directional means may comprise three cylindrical elements H e.g. placed at a 120 degree separation along the circumference of the outer wall of the cylindrical section 302 of the device 100. Each of the cylindrical elements H may act as a lever attached at one end to the cylinder section and connected to an actuator 801 able of extending the other end of the cylindrical element H radially outwards from the cylinder section 302.

In an embodiment, the PLC 309 may receive data, based on which the control signal is calculated, from the sensors in the sensor section F. Additionally, the PLC 309 may receive a control signal via a wireline from the entrance of the tubular channel 199.

Generally, the inflatable and deflatable gripping means G1, G2, G of the devices disclosed with respect to FIGS. 1 and/or 3 and/or 6 and/or 8 may be of the type disclosed with respect to FIG. 2.

Figure 9:
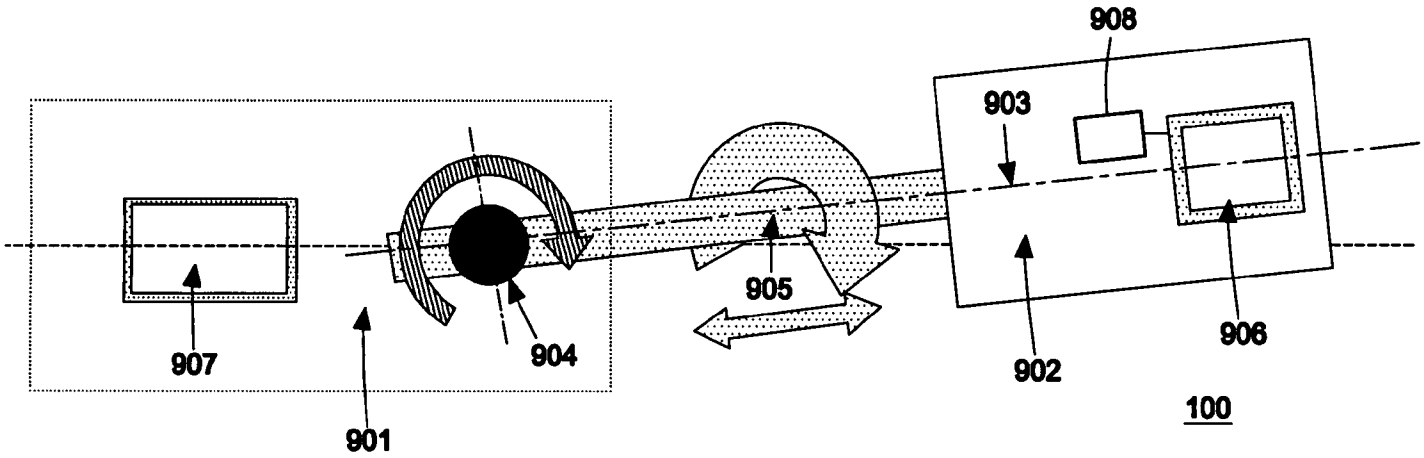
FIG. 9 schematically shows an example of an apparatus for operation in a tubular channel.

FIG. 9 schematically shows an example of an apparatus for operation in a tubular channel, such as a downhole apparatus.

The apparatus, generally designated 100, comprises a first part 901 and a second part 902, connected by connecting member 905. The second part 902 is rotatably connected to the connecting member 905, e.g. by means of a bearing, such that the second part 902 can rotate around axis 903. Furthermore, connecting member 905 is connected to the first part 901 at connecting point 904, e.g. via a pin or the like, such that connecting member 905 can translate along axis 903 and can be tilted around 904. Hence, in this example, the second part 902 is movably connected to the first part 901, such that the second part can be translated along axis 903 and rotated around axis 903. Furthermore the second part 902 can be tilted by rotational movement of pin 904. It will be appreciated that in other embodiments, the parts of the apparatus may be connected with each other by different connection elements, e.g. one or more of the following: a shaft, an axel, a rail, a slide guide, a cam, a piston, etc. Furthermore, the relative movement may include one or more degrees of freedom, and include translational movements, rotational movements, tilt movements, vibrational movements, and/or the like, or a combination thereof.

In order to allow data communication between sensors and/or electrical or hydro-mechanical components, and/or other electronic devices positioned in the respective parts of the apparatus, each part comprises a Bluetooth or other wireless radio communications device 907 and 906, respectively, enabling two-way communications between the first part and the second part of the apparatus. For example, the second part 902 may comprise an electronic device, e.g. connected to or integrated into the communications device 906 for generating a data signal to be communicated by the communications device 906 via the wireless communications link to communications device 907.

The communication is not limited to two communication modules but may comprise multiple sets of communication modules forming a wireless radio or acoustic network using appropriate radio or acoustic frequencies.

Figure 10:
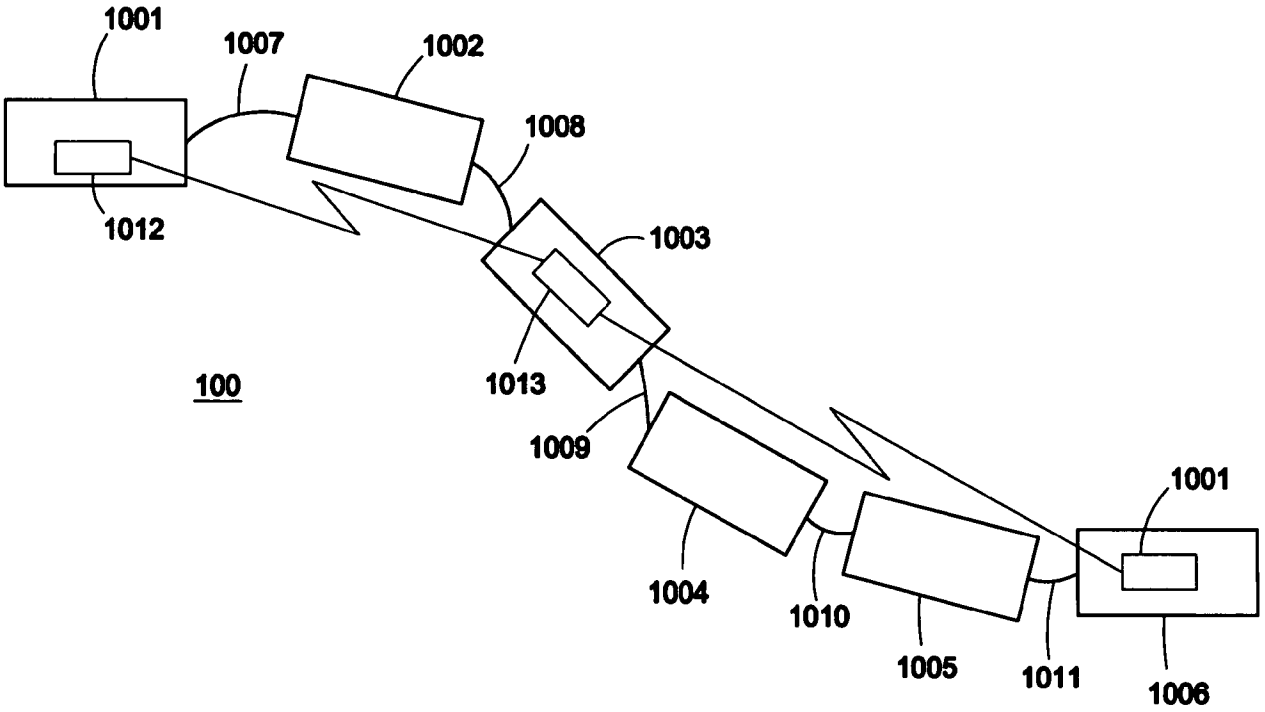
FIG. 10 schematically shows another example of an apparatus for operation in a tubular channel.

For example, FIG. 10 schematically shows another example of an apparatus 100 for operation in a tubular channel, such as a downhole apparatus. In this example, the apparatus includes more than two parts 1001-1006 that are movably interconnected with each other. In the example of FIG. 10, the parts form a chain of modules 1001-1006 that are interconnected by respective connecting members 1007-1011 such that the modules form elements of a chain that can move relative to each other. It will be appreciated that the plurality of parts may be interconnected in a different way and/or so as to form a different type of structure and/or a structure comprising a different number of parts.

In the example of FIG. 10, three modules 1001, 1003, and 1006 of the chain, are equipped with respective radio transceivers 1012, 1013, and 1014, respectively, for providing radio communication with at least one of the other radio transceivers. For example the radio transceivers may be operated to form a radio network allowing communication among all three radio transceivers. Consequently, sensors and/or controllers, and/or other electronic devices located in the respective modules may all be communicatively connected via intra-tool wireless communication links. Alternatively or additionally, e.g. when the distance between two radio transceivers is larger than the range of the radio communication signals communicated between two transceivers, the communication may be relayed by an intermediate transceiver. For example, in order for transceiver 1012 to send a data signal to transceiver 1014, transceiver 1012 may send the signal to transceiver 1013 from which it may be forwarded to transceiver 1014. It will be appreciated that a different number of parts of an apparatus may comprise respective communications devices, e.g. dependent on how many of the parts of an apparatus comprise an electronic device that generates and/or receives data signals to/from other parts of the apparatus, and/or dependent on the range of the communication links relative to the distance between the parts that comprise electronic devices.

Figure 11:
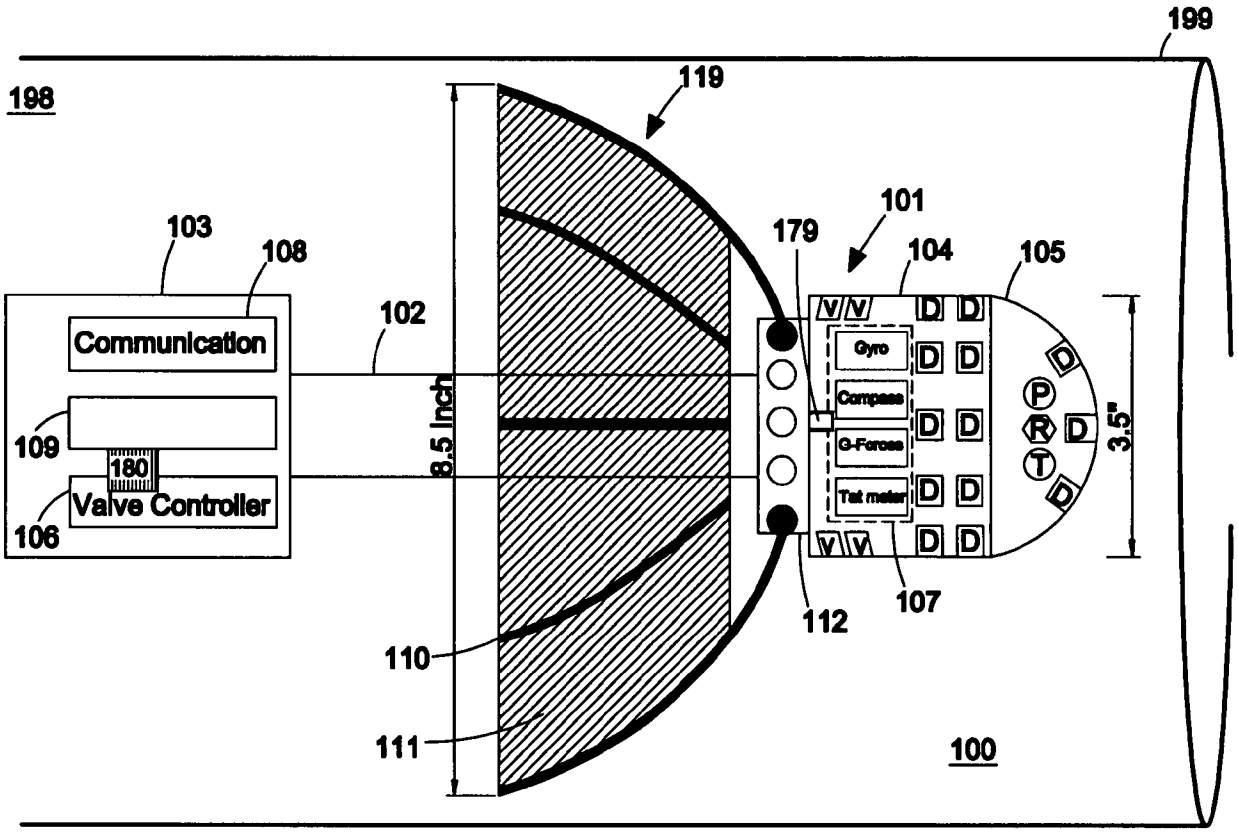
FIG. 11 shows a sectional view of an embodiment of an apparatus for examining a tubular channel comprising a first, a second and a third part.

FIG. 11 shows a sectional view of an embodiment of a device 100 for examining a tubular channel 199 comprising a first 101, a second 102 and a third 103 part. Below and above, a tubular channel may be exemplified by a borehole, a pipe, a fluid-filled conduit, and an oil-pipe.

The tubular channel 199 may contain a fluid. In the above and below, the fluid in the tubular channel may be exemplified by water, hydrocarbons, e.g. petroleum oil or gaseous hydrocarbons such as paraffins, naphthenes, aromatics, asphaltics and/or methane or gases with longer hydrocarbon chains such as butane or propane or any mixture thereof.

The device 100 may for example be pumped down into the tubular channel 199 without any physical connection/link to the surface/entrance of the tubular channel 199. In such an embodiment, the device 100 may be powered by batteries or obtain its power from the earth formation and/or the fluids in the well. Also hydrogen cells or combustion processes can be used to power the device. In the case of batteries, the batteries may be powered/charged by temperature differences of the surrounding via thermocouples and/or by a spinner driven by the fluid motion around the device 100 driving a dynamo being electrically coupled to the batteries. An external communication unit such as a computer communicatively coupled to an acoustic modem, situated in proximity to the entrance of the tubular channel 199 may communicate with the device 100 e.g. via the acoustic modem.

In an alternative embodiment, the device 100 may be connected via e.g. a wire to an external communication unit such as a computer, situated in proximity to the entrance of the tubular channel 199. The external communication unit may provide power to the device 100 via the wire which power could propel the device 100 down into tubular channel 199. Additionally or alternatively, the external communication unit may communicate with the device 100 via the wire.

The three parts 101, 102 and 103 may e.g. be cast or moulded in plastic or aluminium or any other material or combinations thereof suitable of sustaining high pressure, which in high pressure wells can go up to 2000 bar, and temperatures ranging from e.g. 40 degrees C. at shallow depth to 200 degrees C. and beyond in the case of a high temperature well.

The first part 101 may, for example, contain a cylindrical part 104 and a semi-spherical cap part 105. The first part 101 may further contain a number of sensors.

For example, the first part may contain a number of ultrasonic sensors V, e.g. 4 ultrasonic sensors, for determining the relative fluid velocity around the first part 101. An ultrasonic sensor may be represented by a transducer. The ultrasonic sensors V may be contained within the first part 101, e.g. within the cylindrical part 104. The ultrasonic sensors V may provide data representing a fluid velocity.

Additionally, the first part 101 may, for example, include a number of ultrasonic distance sensors D, e.g. 13 ultrasonic distance sensors. The number of ultrasonic distance sensors may provide data representing a distance to e.g. the surrounding tubular channel 199. The ultrasonic distance sensors may be contained within the first part 101. For example, 10 ultrasonic distance sensors may be contained in the cylindrical part 104 of the first part 101, e.g. in a circumference of the cylindrical part 104 and thereby providing data representing a distance between the cylindrical part 104 and the surrounding tubular channel 199, and 3 ultrasonic distance sensors may be contained in the semi-spherical cap part 105, e.g. in the front of the semi-spherical cap part 105 providing data representing a distance between the semi-spherical cap-part and e.g. potential obstacles such as cave-ins/wash-outs in front of the device 100.

The ultrasonic sensors and ultrasonic distance sensors of the first part may be probing the fluid surrounding the device 100 and the tubular channel 199 through e.g. glass windows such that the sensors are protected against the fluid flowing in the tubular channel 199.

The first part may additionally comprise a pressure sensor P. The pressure sensor P may be contained in the semi-spherical cap part 105. The pressure sensor P may provide data representing a pressure of a fluid surrounding the device 100.

Further, the first part may contain an ohmmeter R for measuring the resistivity of the fluid surrounding the device 100. The ohmmeter may be contained in the semi-spherical cap part 105. The ohmmeter may provide data representing resistivity of the fluid surrounding the device 100.

Further, the first part may contain a temperature sensor T for measuring the temperature of the fluid surrounding the device 100. The temperature sensor T may be contained in the semi-spherical cap part 105. The temperature sensor T may provide data representing a temperature of the fluid surrounding the device 100.

The first part may additionally comprise a position-determining unit 107 providing data representing the position of the first part 101, and thus enabling position tagging of the data from the abovementioned sensors. The position tagging may, for example, be performed with respect to e.g. the entrance of the tubular channel 199.

In an embodiment, the position-determining unit 107 may comprise one or more gyroscopes, a compass, one or more accelerometers, and/or a tiltmeter (inclinometer).

The device 100 may further comprise a programmable logic controller (PLC) 180 e.g. contained in the first 101 or in the third part 103. One or more of the above sensors, i.e. the ultrasonic sensors V, the ultrasonic distance sensors D, the pressure sensor P, the ohmmeter R, the temperature sensor T, and the position-determining unit 107, may be connected to the PLC via a wireless communications channel. To this end, the first and third parts may comprise respective wireless communications units 109 and 179, e.g. short-range radio units, as described herein for establishing a wireless communications channel between the parts. The communications unit 179 may be connected to the sensor(s) e.g. via a ND converter and/or multiplexer, and the communications unit 109 may be connected to the PLC. Via a number of data input from the sensors, the PLC is able to determine the surroundings and position of the device 100 and to calculate a control signal representing how the device 100 is to be steered. Thus, the PLC 180 may determine how to navigate through the tubular channel 199 via one or more of the steering mechanisms disclosed below. For example, the PLC 180 may be communicatively coupled, e.g. via the communications unit 109 and respective wireless communications channels, to each of the steering mechanisms, and the PLC 180 may control the steering mechanisms via the control signal. To this end one or more of the steering mechanisms may be connected to one or more wireless communications units as described herein, thus allowing wireless communication with the PLC.

Figure 12:
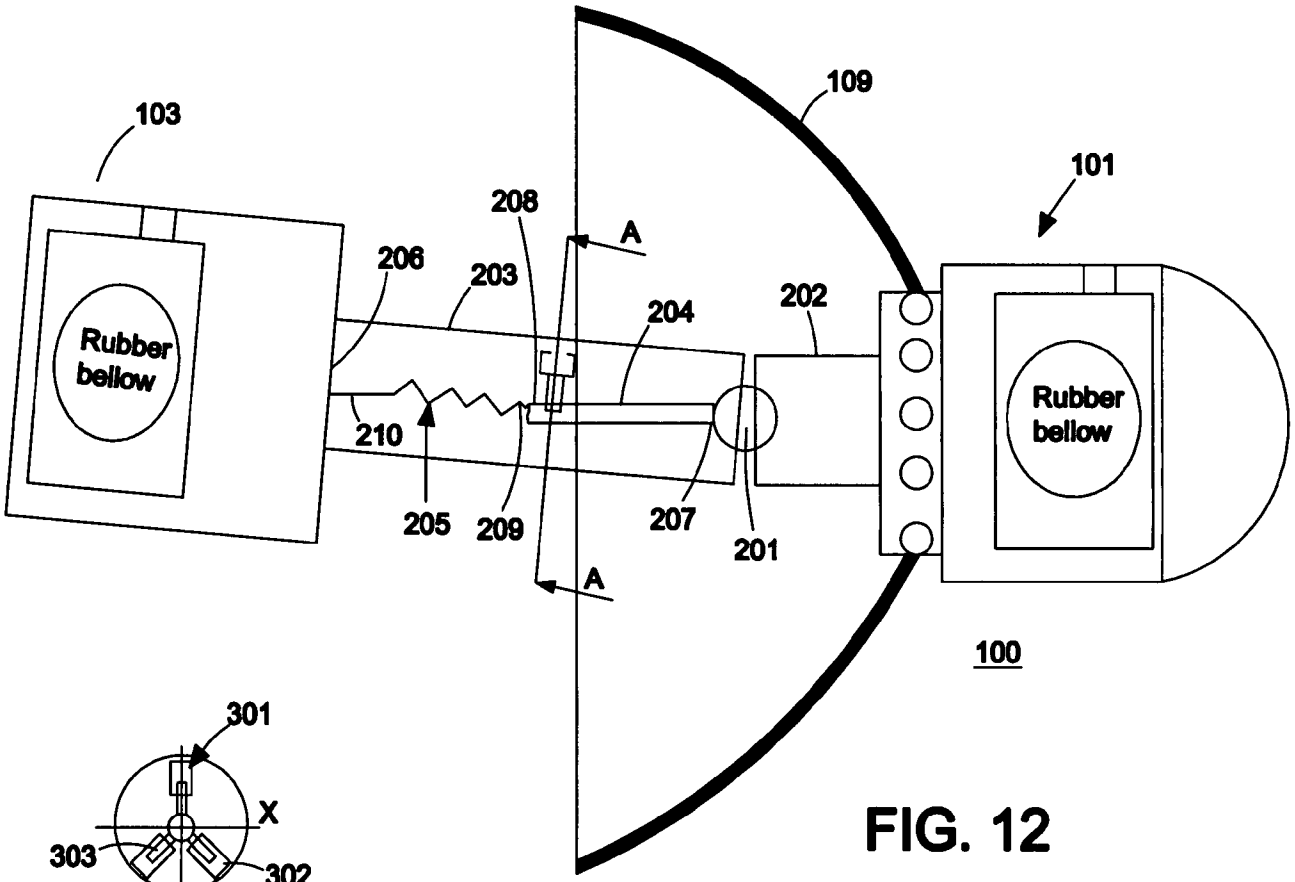
FIG. 12 shows the fishing neck of the device.

The second part 102 may comprise a two-piece bar ("fishing neck") 202 and 203 connected via a ball joint 201 as seen in FIG. 12. The two-piece bar 202, 203 may have a cylindrical cross-section and may be hollow. Further, the two-piece bar 202, 203 may connect the first part 101 to the third part 103 via the ball joint 201. As illustrated in the figure, a first part 202 of the two-piece bar 202, 203 may be connected to the first part 101 of the device 100 and a second part 203 of the two-piece bar 202, 203 may be connected to the third part 103 of the device 100.

One of the two-piece bar parts, e.g. the second part 203, may contain a bar 204 physically connected at one end 207 to the ball joint 201 e.g. via glue, weld joint or the like. The other end 208 of the bar may be connected to a first end 209 of a spring 205. The other end 210 of the spring 205 may be physically connected to a side 206 of the second part 102 of the device 100 e.g. the side also connected to the second part 203 of the two-piece bar. The force exerted by the spring on the side 206 and the other end 208 of the bar 204 is of such a magnitude as to keep the device 100 i.e. the first part 202 and the second part 203 of the two-piece bar, in a straight line (e.g. 180 degrees +/−1 degree between the first part and the second part of the two-piece bar) via the ball-joint 201 when none of the cylinders disclosed below are activated.

Figure 13:
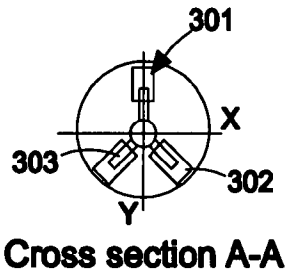
FIG. 13 shows a cross-sectional view of the fishing neck of the device.

A cross-sectional view along the line A-A in FIG. 12 is shown in FIG. 13. FIG. 13 illustrates three cylinders 301. The cylinders 301 may e.g. be hydraulic or mechanical or a combination of hydraulic and mechanical cylinders (for example, a first cylinder may be mechanical and a second and a third cylinder may be hydraulic).

Each cylinder may comprise a cylinder barrel 302 and a piston 303. The cylinder barrels 302 may be connected to the inner wall of the second part 203 of the two-piece bar. The connection may be performed e.g. by a weld joint or a screw or glue or the like. The pistons 303 may be connected to the other end of the bar 208 e.g. by weld joints, glue, screws or the like.

The barrels 302 of the cylinders 301 may e.g. be placed at a 120 degree separation along the circumference of the inner wall of the second part 203 of the two-piece bar.

In order to steer the device 100, one or more of the cylinders may be activated in order to displace the bar 204 from the equilibrium position determined by the spring 205. The cylinders 301 may be able to displace the bar 204 in any position. In FIG. 3, for example, the top cylinder 301 has been activated and displaced the bar 204 from its spring determined equilibrium position determined by the intersection of the two lines X and Y. Thereby, the straight line between the first part 202 and the second part 203 of the two-piece bar is changed e.g. to 135 degrees +/−1 degree whereby the device 100 longitudinal axis is bend around the ball joint 201.

If the three cylinders are hydraulic, then the spring 205 may be replaced by springs in the cylinders such that when the cylinders are un-activated, the spring forces of the springs in the cylinders are of such a magnitude as to keep the device 100 i.e. the first part 202 and the second part 203 of the two-piece bar, in a straight line. The springs are located in the cylinders pushing on the pistons e.g. between the pistons 303 and the bar 204.

In an embodiment, the springs between the pistons 303 and the bar 204 may be push springs.

The bar 204 and the ball joint 201 may be hollow such as to, for example, allow passage of an electric wire from the first part 101 to the third part 103 via the two-piece bar and the ball-joint 201 and the bar 204. Additionally, the bar 204 and the ball joint 201 may allow passage of a tube e.g. a high pressure tube.

Thus, the device 100 may be steered by controlling the cylinders 301 and thereby the fishing-neck of the device 100.

Figure 14:
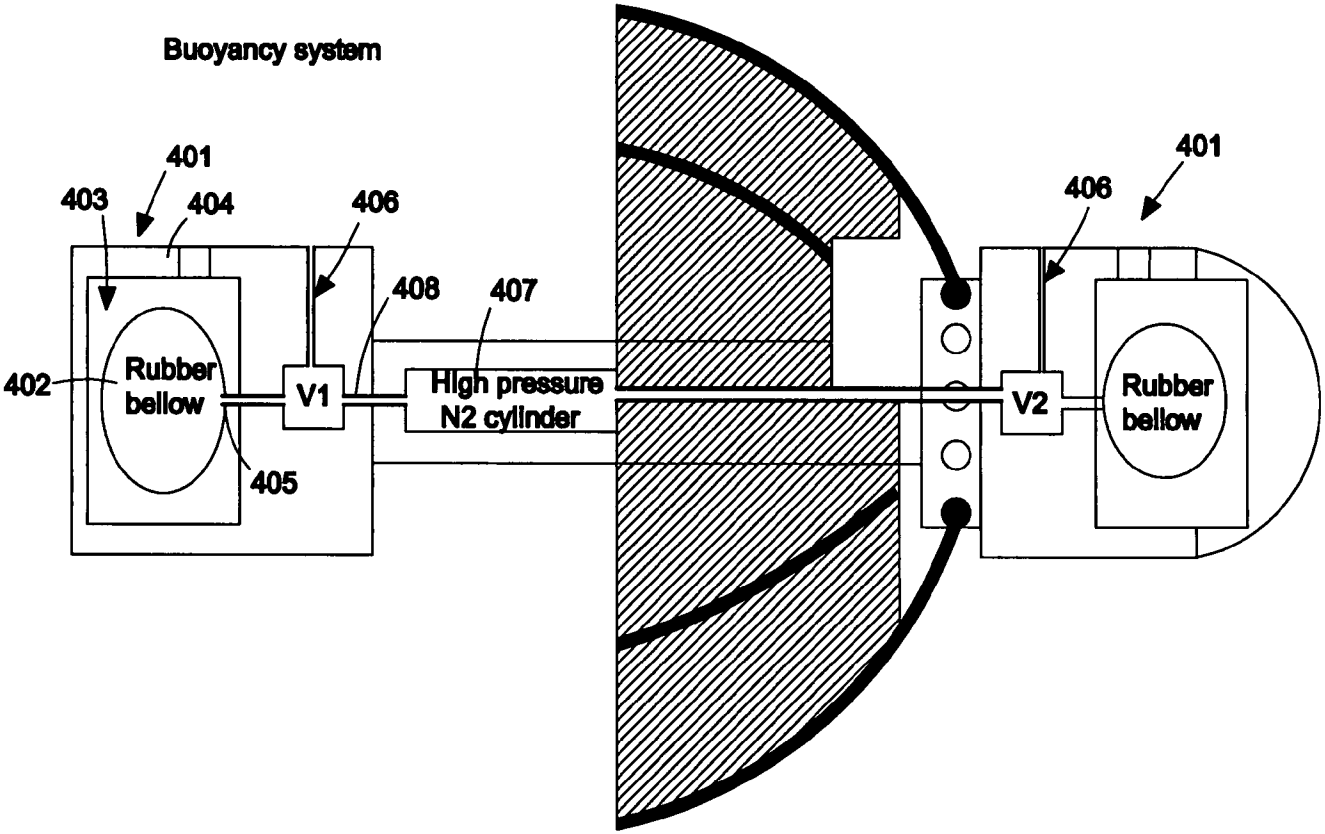
FIG. 14 shows an embodiment of a device 100 for examining a tubular channel comprising buoyancy means.

In an embodiment, the high pressure cylinder 407 of FIG. 14 may be in fluid communication with the three hydraulic cylinders of FIG. 2 e.g. via high pressure tubes and respective valves and chokes (to provide more accuracy to the fluid flow by limiting the volume per unit time). Thereby, the three hydraulic cylinders 301 may be powered by the high pressure cylinder 407. The amount of second fluid transferred from the high pressure cylinder 407 to the cylinders 301 may be controlled by the PLC 180 via the control signal by controlling the valves.

In the above and below, the second fluid contained in the high-pressure cylinder 407 may be chosen from the group of fluids which are known for their expansion when the pressure drops. The most effective fluids are therefore gaseous. For example Nitrogen or Helium or hydrocarbon gas or $CO_2$ could be used as the second fluid with which the cylinder 407 is filled.

In an alternative embodiment, the three cylinders may be mechanical cylinders being controlled and driven by motors.

The third part may additionally comprise a valve controller 106 for controlling a number of valves as disclosed below.

The device 100 may further comprise a flexible member 119. For example, the flexible member may comprise arms 110 made of titanium and a texture 111 made of aramid. The flexible member 119 may have a semi-spherical shape as indicated in FIG. 11 and the device 100 may, for example, be able to adjust the maximal outer diameter of the semi-spherical shape between for example 3.5 inch (88.9 mm) and 8.5 inch (215.9 mm). The outer diameter is limited by the fact that the flexible member cannot expand further than the mentioned 8.5 inch because the flexible member has reached its maximum outer diameter. In a tubular channel with an inner diameter of below 8.5 inch, the outer diameter of the flexible member may be determined by the inner diameter of the tubular channel. Thereby, the device is able to run through tubing and thus, the top completion of a well does not have to be removed (pulled of) in order to run the device into the well.

The flexible member 119 may e.g. be attached to the first part 101. For example, the first part 101 may comprise a cylindrical attachment part 112 to which the flexible member 119 may be attached e.g. via weld joints or a ball bearing. The projection of the flexible member on the second part 102 may be varied and it may depend on the outer diameter of the semi-spherical shape. If for example the flexible member 119 is fully expanded (maximal outer diameter) then the projection of the flexible member 119 onto the second part 102 (i.e. the longitudinal axis of the device 100) is minimal. If for example the flexible member 119 is fully collapsed (minimal outer diameter) then the projection of the flexible member 119 onto the second part 102 is maximal. Alternatively or additionally, the projection of the flexible member 119 onto the second part 102 may be varied by altering the angle of the flexible member. Changing the angle of the flexible member will cause an unbalanced push force on the flexible member versus the axis of the device this will move the device away from the axis.

The flexible member 119 may, for example, be utilized in propelling the device 100 down the tubular channel 199. By applying a pressure on the entrance 198 side of the tubular channel 199 may expand the flexible member 109 to its maximal size, whereby the device 100 may be propelled down the tubular channel 199. If, for example, the device 100 encounters a cave-in (or a wash-out) in its path, the device 100 may change the maximal outer diameter of the flexible member such as to enable passage of the device 100 past the cave-in by adapting the outer diameter of the device 100 to the diameter of the cave-in.

FIG. 14 shows an embodiment of a device 100 for examining a tubular channel comprising buoyancy means 401. The device 100 of FIG. 14 may comprise the technical features described under FIGS. 11 and/or 12 and/or 13.

Further, the device of FIG. 14 may comprise buoyancy means 401 (e.g. float tanks or hydrophores) in the first part 101 and in the third part 103. Each of the buoyancy means 401 may comprise a rubber bellow 402 contained in a titanium cylinder 403. The titanium cylinders 403 prevent the rubber bellows 402 from bursting. The titanium cylinders 403 further comprise an in/outlet 404 enabling fluid from the tubular channel 199 to enter or exit. The in/outlet 404 of the titanium cylinders may be covered with a permeable metal membrane.

The first part 101 and the third part 103 may each further comprise a three-way valve V1, V2. The three-way valve V1, V2 may be fluidly coupled to the respective rubber bellow 402 e.g. via respective tubes 405. Further, the three-way valves V1, V2 may be fluidly coupled to the fluid in the tubular channel via respective vent lines 406. Additionally, each of the three-way valves V1, V2 may be fluidly coupled to a high pressure cylinder 407, e.g. situated in the second part 102 of the device 100, via respective tubes 408. The high pressure cylinder 407 may contain a second fluid.

The three-way valves V1, V2 may be controlled by the valve controller 106 which may be communicatively coupled to the three-way valves V1, V2 e.g. via an electric wire or a wireless communications channel. The valve controller 106 may, for example, receive control signals from the PLC ordering the valve controller 106 to increase and/or decrease buoyancy of the buoyancy means 401 according to the calculation results obtained by the PLC. The PLC may be communicatively coupled to the valve controller 106 via a wireless communications channel as described herein. Using the high pressure cylinder 407 and the three-way valves 406 and the buoyancy means 401, the device 100 is able to control its buoyancy.

For example, in the event that the rubber bellows 402 are filled with the second fluid e.g. N2 and the buoyancy is to be decreased i.e. the device 100 has to dive, then the three-way valve V1, V2 is opened between the rubber bellow 402 and the N2 vent line 406, whereby fluid from the tubular channel 199 may enter the titanium cylinder 403 via the permeable metal membrane 404 and simultaneously, the second fluid may flow out of the rubber bellow 402 through the N2 vent line 406 due to the elastic pressure exerted by the rubber bellow 402 on the second fluid. When the buoyancy of the device has been decreased sufficiently, e.g. determined by one or more of the sensors and the PLC 108, the three-way valve 406 is set in a closed position by receiving a control signal from the PLC 180.

Subsequently, if the buoyancy of the device 100 is to be increased i.e. the device 100 has to be raised, then the three-way valve V1, V2 is opened between the rubber bellow 402 and the high pressure cylinder 407, whereby the second fluid of the high pressure cylinder 407, e.g. N2, is pressed into the rubber bellow 402. Thereby, the rubber bellow 402 expands and thus displaces the fluid, e.g. fluid from the tubular channel, present in the titanium cylinder 403 via the permeable metal membrane 404. When the buoyancy of the device has been increased sufficiently, e.g. determined by one or more of the sensors and the PLC 108, the three-way valve 406 is set in a closed position by receiving a control signal from the PLC 180.

In an embodiment, a spinner/impeller may be attached to the permeable metal membrane 404 or placed inside the permeable metal membrane such that the spinner is spun when the fluid from the tubular channel 199 flows in or out via the permeable metal membrane 404. Thereby, the spinner is able to act as a dynamo and if the device 100 is powered by batteries, the spinner may be electrically coupled, e.g. via an electric wire, to the batteries of the device 100, and thereby the batteries may be recharged by the spinner.

In an embodiment, the three-way valves V1, V2 may be equipped with a flow restriction in order to limit the flow volume per unit time to thereby allow a certain accuracy of the three-way valves.

Thus, the device 100 may be steered by controlling its buoyancy using the high pressure cylinder 407, a three-way valve V1, V2, and the buoyancy means 401. The buoyancy of the device 100 may be controlled by the PLC 180 receiving data from the sensors and transmitting a control signal to the three-way valves V1, V2. Alternatively, the buoyancy of the device 100 may be controlled by the external communication unit receiving data from the sensors and transmitting a control signal to the three-way valves V1, V2.

In an embodiment, the buoyancy means 401 may be used to e.g. steer the first part 101 up or down with respect to the ball joint 201 e.g. by increasing the buoyancy of the buoyancy means 401 in the first part 101, e.g. by pumping the second fluid from the high pressure cylinder 407, e.g. N2, into the rubber bellow 402 of the first part 101 thereby displacing fluid from the titanium cylinder 403 to the tubular channel, and/or decreasing the buoyancy of the buoyancy means 401 in the third part 103, e.g. by displacing the second fluid from the rubber bellow 402 with fluid from the tubular channel 199 in the titanium cylinder 403 of the third part 103, as disclosed above.

FIG. 5 shows an embodiment of a device 100 for examining a tubular channel comprising jet nozzle means. The device 100 of FIG. 5 may comprise the technical features described under FIGS. 11 and/or 12 and/or 13 and/or 14. Further, the device of FIG. 5 may comprise jet nozzle means 501 in the first part 101 and in the third part 103.

Each of the jet nozzle means 501 may comprise a number of nozzles 502, e.g. 5 nozzles, through which a jet of second fluid may be thrust. Additionally, the jet nozzle means 501 may comprise a valve array 503. The valve array 503 may be fluidly coupled to the high pressure cylinder 407 via e.g. respective high pressure tubes 504. Additionally, the valve array 503 may be fluidly coupled to each of the nozzles via respective high pressure tubes 505.

Figure 15:
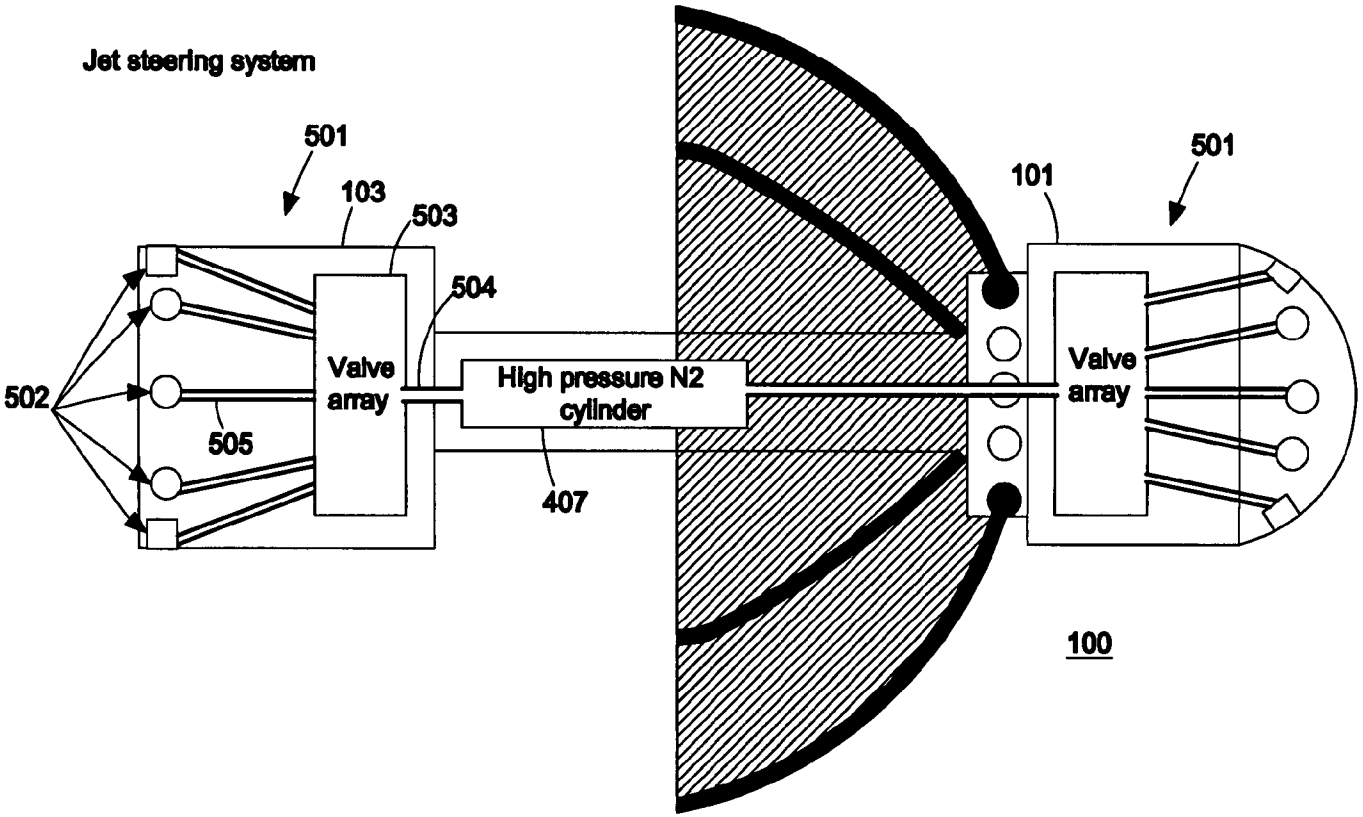
FIG. 15 shows an embodiment of a device 100 for examining a tubular channel comprising jet nozzle means.

The nozzles 502 may be placed in the rear of the third part 103 and in the front of the first part 101 as seen in FIG. 15. Further, the nozzles may be in fluid communication with the fluid in the tubular channel 199 thereby enabling each nozzle to eject the second fluid, e.g. a high pressure fluid, from the high pressure cylinder 407 when enabled to do so via the valve array 502. The valve array 503 may be communicatively coupled to the PLC 180 e.g. via electric wires or a wireless communications channel as described herein, such that the valve array 503 may be controlled by the PLC 180 e.g. based on sensor data treated by the PLC 180.

If, for example, the device 100 is to move straight forward, the valve array 501 may open a valve between the high pressure cylinder 407 and the centre nozzle 502 in the valve array 503 of the third part 103 thereby establishing a fluid coupling between the high pressure cylinder 407 and the centre nozzle 502. Thus, the second fluid may be trust from the high pressure cylinder 407 via the centre nozzle 502 straight backwards into the fluid of the tubular channel 199. Therefore, the device 100 will move in the opposite direction of the thrust second fluid due to conservation of momentum i.e. straight forward.

If, for example, the device 100 is to move backwards and downwards, the valve array 501 may open a valve between the high pressure cylinder 407 and the top nozzle 502 in the first part 101 thereby establishing a fluid coupling between the high pressure cylinder 407 and the top nozzle 502. Thus, the second fluid may be trust from the high pressure cylinder 407 via the top nozzle 502 upwards and forwards into the fluid of the tubular channel 199. Therefore, the device 100 will move in the opposite direction of the thrust the second fluid due to conservation of momentum i.e. downwards and backwards.

Thus, the device 100 may be steered using the nozzles 502, the valve array 501 and the high pressure cylinder 407. The second fluid ejected from the nozzles of the device 100 may be controlled by the PLC 180 receiving data from the sensors and transmitting a control signal to the valve array 503 controlling the valve fluidly coupled to the nozzle(s) from which the second fluid is to be ejected. Alternatively, the second fluid ejected from the nozzles of the device 100 may be controlled by the external communication unit 102A receiving data from the sensors and transmitting a control signal to the valve array 503.

Figure 16:
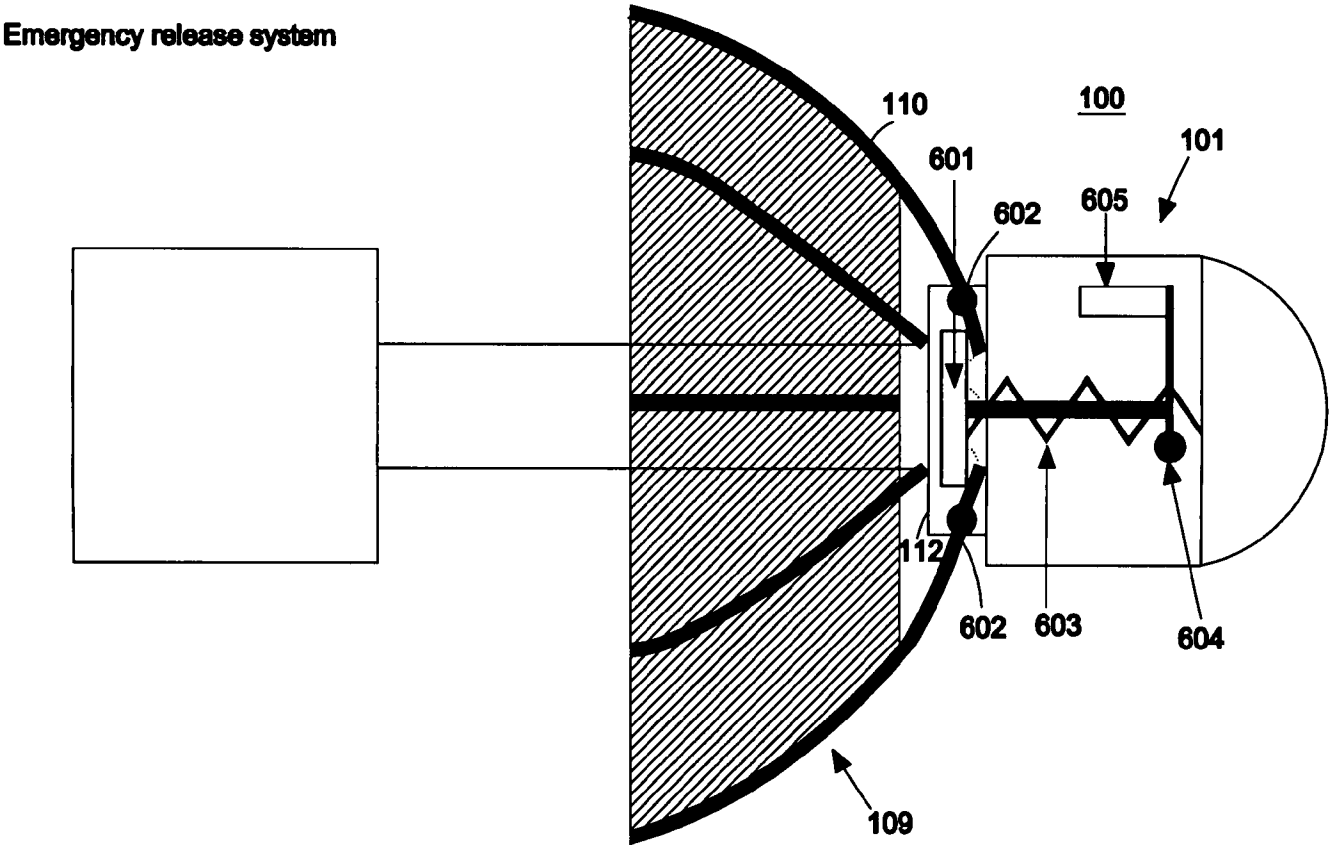
FIG. 16 shows an embodiment of a device 100 for examining a tubular channel comprising means for contracting the flexible member.

FIG. 16 shows an embodiment of a device 100 for examining a tubular channel comprising means for contracting the flexible member. The device 100 of FIG. 6 may comprise the technical features described under FIGS. 11 and/or 12 and/or 13 and/or 14 and/or 15.

Further, the device 100 of FIG. 16 may, in the first part 101, comprise a disc 601, e.g. positioned in the cylindrical attachment part 112, to which disc 601 the arms 110 of the flexible member 119 may be in physical contact. Further, the arms 110 may be attached to the cylindrical attachment part 112 via ball bearing 602 or the like enabling the flexible arms 110 to rotate around the ball bearing 602. Thereby, by translating the disc 601 to the right of FIG. 16, the arms 110 may be collapsed and by translating the disc 601 to the left of FIG. 16, the arms may expand e.g. due to fluid pressure in the tubular channel 199. Further, the first part 101 may comprise a spring 603, a second rotating bar 604 and an electro-magnet 605 further described under FIG. 17.

Figure 17:
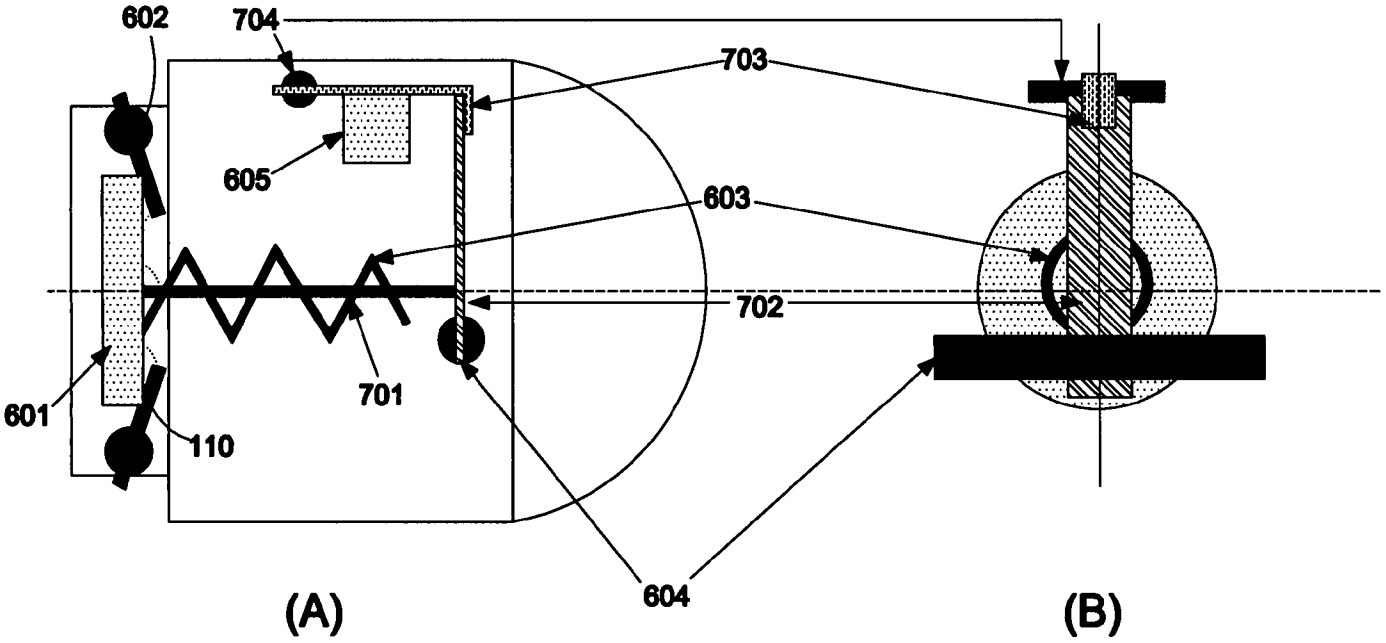
FIG. 17 shows an enlargement of the first part of an embodiment of the device.

FIG. 17 shows an enlargement of the first part 101 of the device 100 of FIG. 16. FIG. 17A) is a side view of the first part 101 and FIG. 17B) is a front view. The first part comprises the ball bearings 602, the arms 110, the disc 601, the electro-magnet 605, the spring 603 and the second rotating bar 604. Additionally, the first part comprises a pin 701 attached at one end to the disc 601. The pin is further connected to the spring 603 which may be a pull spring. The spring 603 pulls the pin 701 attached to the disc 601 to the right of FIG. 7. Thereby, the other end of pin 701 pushes on a plate 702. The plate 702 is held in place in one end by a second plate 703 and in the other end by the rotating bar 604. The second plate 703 is held in place by the electro-magnet 605 and one end to a first rotating bar 704 and the other end is holding the first end of the plate 702. Thus, when power to the electro-magnet 605 is terminated, the electro-magnet 605 releases the second plate 703 which rotates around the first rotating bar 704. Thereby, the first end of the plate 702 is released and the plate 702 rotates around the second rotating bar 604 allowing the pin 701 to move to the right of FIG. 17, whereby the disc 601 is moved to the right thus exerting a force on the arms 110. Thereby, the arms 110 and thus also the texture 111 are collapsed.

With the above design, the force required to hold the pin 701 in position is small, e.g. in the order of half a newton.

By being able to decrease the outer diameter of the device 100 via the flexible member 119, the device 100 may adjust its outer diameter according to obstructions in the tubular channel 199. Further, should the device 100 become stuck in a tubular channel 199, e.g. due to a wash-out or the like, the device is able to collapse the flexible member 109 via the means for contracting the flexible member disclosed with respect to FIG. 16 and FIG. 17. In an embodiment, the PLC 180 may be communicatively coupled to the electro-magnet 605, e.g. via a wireless communications channel as described herein. By transmitting a control signal to the electro-magnet 605, the PLC 180 may control the electro-magnet 605 e.g. in the event where the device 100 velocity is zero m/s for a given period e.g. one minute. When receiving the control signal, the electro-magnet may be turned off and thereby collapsing the flexible member as disclosed above.

In an embodiment, the electro-magnet 605 may be replaced by an acid soluble member and the pin 701 may be released by providing contact between the acid soluble member 605 and the plate 703. Thereby, the plate 703 may be etched through whereby the first end of the plate 702 is released and the plate 702 rotates around the second rotating bar 604 allowing the pin 701 to move to the right of FIG. 17, whereby the disc 601 is moved to the right thus exerting a force on the arms 110. Thereby, the arms 110 and thus also the texture 111 are collapsed.

In an embodiment, the device 100 may comprise a mechanical arm which may be used to push the device 100 from a tubular channel 199 wall opposite the direction the device 100 wants to move in.

As an example, the device 100 may be heading towards a wall of the tubular channel 199. The ultrasonic distance sensors transmit data to the PLC which determines that in order to avoid the wall, the upper front nozzle should eject the second fluid. Subsequently, the PLC 180 transmits a control signal indicating how much and/or how long the valve in the valve array 503 controlling the upper front nozzle should open to the valve array 503. When the valve array 503 receives the control signal, the valve fluidly coupled to the upper front nozzle is opened and a jet of second fluid is ejected from the nozzle.

Further, as an example, the device 100 may be heading towards a leg of a fishbone well. The ultrasonic distance sensors transmit data to the PLC which determines that in order to avoid the leg of the fishbone well, the buoyancy of the device 100 should be increased. Subsequently, the PLC 180 transmits a control signal indicating how much and/or how long the valves V1, V2 controlling the fluid coupling between the rubber bellows 402 and the high pressure cylinder 407 should open. When the valves V1, V2 receive the control signal, the valves open according to the control signal and the second fluid from the high pressure cylinder 407 enters the rubber bellows 402 thereby increasing the buoyancy of the device 100.

In an embodiment, the device 100 may be pumped down via the flexible member 119, as disclosed above, a certain length of the tubular channel 199, e.g. the cased part of the tubular channel 199, and from thereof, i.e. in the open hole completion part of the well, the device may propel itself via the nozzles 502, as disclosed above.

In an embodiment, the device 100 may be lowered a certain distance into of the tubular channel 199 by gravity, e.g. until the angle between the tubular channel 199 and vertical exceeds 60 degrees in which the gravitational force in most cases is not high enough to overcome the friction between the fluid and the device 100. From this point of, the device 100 may propel itself via one or more of the above disclosed means e.g. the jet nozzle means 501 and/or the flexible member 119.

In an embodiment, the device 100 may be connected to a tractor which may move a distance into the tubular channel 199, e.g. to an area of interest of a user of the device 100, and subsequently, the device 100 may be released from the tractor in order to propel itself via one or more of the above disclosed means e.g. the jet nozzle means 501 and/or the flexible member 109.

In an embodiment, the device 100 may be connected to a drilling assembly via a wire. The drilling assembly may be positioned in proximity to the external communication unit (e.g. containing the external communication unit) at the surface of the tubular channel 199. Alternatively, the drilling assembly may be positioned in the tubular channel 199.

Embodiments of the invention have mainly been described with reference to a downhole apparatus. However, it will be appreciated that the invention may also be applied to other types of apparatus for use in other types of tubular channels, such as a pipe, a fluid-filled conduit, and an oil-pipe.

In the claims enumerating several means, several of these means can be embodied by one and the same element, component or item of hardware. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, elements, steps or components but does not preclude the presence or addition of one or more other features, elements, steps, components or groups thereof.

The invention claimed is:

1. A downhole apparatus configured to move through a well in rock for operation in a in a drilled bore, the downhole apparatus being configured to be installed temporarily or permanently in the drilled bore, the apparatus comprising:

a first part; and a second part connected to the first part, wherein the second part comprises a first electronic device configured to generate a data signal and a first communications device for wirelessly transmitting the generated data signal via a wireless short-range radio-frequency communications channel, wherein the first part comprises a second communications device for wirelessly receiving the transmitted data signal via said wireless short-range radio-frequency communications channel, wherein the first and second communications devices in use are configured to communicate with each other via the short-range radio-frequency communications channel, wherein the wireless communications channel operates in a 2.4 GHz radio communication spectrum, wherein the first part comprises a reservoir comprising a fluid and sealed from a pressure chamber comprising a fluid and a piston dividing the pressure chamber into a first and a second piston pressure chamber fluidly coupled via a pump;

wherein the second part is attached to the first part via a hollow tubular member extending from the reservoir through the pressure chamber; and wherein the hollow tubular member is attached to the piston such that translation of the piston via a pressure difference between the first and a second piston pressure chamber established by the pump results in translation of the hollow tubular member and the second part.

2. The apparatus according to claim 1, wherein the data signal is a sensor signal, and wherein the first electronic device is a sensor for generating the sensor signal indicative of a measured property.

3. The apparatus according to claim 1, wherein the first part further comprises a second electronic device configured to process the received data signal.

4. The apparatus according to claim 3, wherein the second electronic device is a control unit for generating a control signal for controlling a controllable function of the apparatus.

5. The apparatus according to claim 4, wherein the controllable function includes a relative movement of the second part relative to the first part.

6. The apparatus according to claim 4, wherein the controllable function is a controllable function of the second part, wherein the second communications device is further configured to wirelessly transmit the control signal, wherein the first communications device is further configured to receive the transmitted control signal, and wherein the second part comprises a control unit for controlling the controllable function of the second part.

7. The apparatus according to claim 1, wherein the first and second parts include respective metallic housings and wherein the first and second communications devices are arranged inside the respective metallic housings.

8. The apparatus according to claim 1, wherein the first and second communications devices are configured to communicate with each other via a direct radio-frequency communications link or a communications link only including one or more relay communications devices comprised in the apparatus.

9. The apparatus according to claim 1, wherein the first and second communications devices are configured to communicate with each other via a radio-frequency communications channel using a protocol according to the IEEE 802.11 or IEEE 802.15 standard.

10. The apparatus according to claim 1, wherein the second part is movably connected to the first part.

11. The apparatus according to claim 1, wherein the apparatus is a tractor configured to move along the tubular channel.

12. The apparatus according to claim 1, wherein the first part comprises a reservoir comprising a fluid and sealed from a pressure chamber comprising a fluid and a piston dividing the pressure chamber into a first and a second piston pressure chamber fluidly coupled via a pump;

wherein the second part is attached to the first part via a hollow tubular member extending from the reservoir through the pressure chamber;

wherein the hollow tubular member is attached to the piston such that translation of the piston via a pressure difference between the first and a second piston pressure chamber established by the pump results in translation of the hollow tubular member and the second part;

wherein a first gripping means is attached to the first part and a second gripping means is attached to the second part and the two gripping means are fluidly connected via the pump;

wherein a first of the two gripping means comprises a fluid;

wherein the pump is configured to inflate a second of the gripping means by pumping the fluid from the first of the two gripping means to the second of the two gripping means; and wherein the gripping means comprises a flexible member contained in a woven member, wherein the flexible member provides fluid-tightness and the woven member provides the shape of the gripping means.

13. The apparatus according to claim 12, wherein inflation of the second gripping means attached to the second part is performable by pumping the fluid from the first gripping means via the reservoir and the hollow tubular member to the second gripping means.

14. The apparatus according to claim 1, comprising two gripping means fluidly connected via a pump;

wherein a first of the two gripping means comprises a fluid; wherein the first gripping means are attached to the first part, and the second gripping means are attached to the second part;

wherein the pump is configured to inflate a second one of the gripping means by pumping the fluid from the first of the two gripping means to the second of the two gripping means; and wherein the gripping means comprises a flexible member contained in a woven member, wherein the flexible member provides fluid-tightness and the woven member provides the shape of the gripping means.

15. The apparatus according to claim 14, wherein the first part comprises a reservoir comprising a fluid and sealed from a pressure chamber comprising a fluid and a piston dividing the pressure chamber into a first and a second piston pressure chamber fluidly coupled via a pump;

wherein the second part is attached to the first part via a hollow tubular member extending from the reservoir through the pressure chamber; and wherein the hollow tubular member is attached to the piston such that translation of the piston via a pressure difference between the first and a second piston pressure chamber established by the pump results in translation of the hollow tubular member and the second part.

16. The apparatus according to claim 14, wherein inflation of the second gripping means attached to the second part is performed by pumping the fluid from the first gripping means via the reservoir and the hollow tubular member to the second gripping means.

17. The apparatus according to claim 14, wherein the apparatus further comprises a pressure relief valve fluidly coupled to the pump to determine a maximal pressure pumped into the gripping means.

18. The Apparatus according to claim 1 further comprising, a first gripping means attached to the first part and a second gripping part attached to the second part and wherein the two gripping means are fluidly coupled via the pump;

wherein a first of the two gripping means comprises a fluid;

wherein the pump is configured to inflate a second of the gripping means by pumping the fluid from the first of the two gripping means to the second of the two gripping means; and wherein the gripping means comprises a flexible member contained in a woven member, wherein the flexible member provides fluid-tightness and the woven member provides the shape of the gripping means.

19. The apparatus according to claim 18, wherein inflation of the second gripping means attached to the second part is performed by pumping the fluid from the first gripping means via the reservoir and the hollow tubular member to the second gripping means.

20. The apparatus according to claim 18, wherein the apparatus further comprises a pressure relief valve fluidly coupled to the pump to determine a maximal pressure pumped into the gripping means.

21. The apparatus according to claim 1, wherein the apparatus further comprises at least one sensor communicatively coupled via the wireless communications channel to a control unit contained in the first part, and wherein the control unit is configured to generate a control signal for controlling the pump based on data from the at least one sensor.

22. The apparatus according to claim 21, wherein the apparatus further comprises an acoustic modem communicatively coupled to the control unit such that the control unit is configured to transmit date received from the at least on sensor to a receiver at the entrance of the tubular channel.

23. The apparatus according to claim 1, further comprising at least one directional means comprising a lever attached at one end to an outer side of the apparatus and activated by an actuator attached at one end to the outer side of the apparatus and the other end to the lever.

24. The apparatus according to claim 1, comprising a three-way valve, buoyancy means, pressure means, a vent line, at least one sensor and computation means; wherein the three-way valve is configured to control the fluid flow between the pressure means and the buoyancy means and between the buoyancy means and the vent line;

wherein the computation means is communicatively coupled to the at least one sensor and configured to generate a control signal based on data received from the at least one sensor; and wherein the pressure means is fluidly coupled to the buoyancy means via the three-way valve such that a fluid may flow from the pressure means to the buoyancy means or from the buoyancy means to the surroundings of the device via the vent line; and wherein the computation means is communicatively coupled to the three-way valve and controls said three-way valve via the control signal; wherein the computation means is communicatively coupled to at least one of the three-way valve and the at least one sensor via the wireless communications channel.

25. The apparatus according to claim 24, wherein the buoyancy means are contained in a first part of the apparatus; the pressure means are contained in a second part of the apparatus; another buoyancy means are contained in a third part of the apparatus; and wherein the first part and the third part connected via said second part and wherein the second part comprises of two hollow pieces joined via a ball joint.

26. The apparatus according to claim 25, wherein a first of the two hollow pieces comprises a spring and a bar, and wherein one end of the bar is connected to the ball joint and another end of the bar is connected to the spring, which spring is configured to keep the two hollow pieces of the second part in a straight line.

27. The apparatus according to claim 24, wherein the apparatus further comprises a plurality of flexible arms having one end connected to the circumference of the device and another end extending radially out from the apparatus at a radius larger than the radius of the apparatus and a maximal outer diameter determined by a texture stretched between the flexible arms.

28. The apparatus according to claim 27, wherein the apparatus is configured to contract the other end of the plurality of flexible arms to a radius of approximately the radius of the apparatus when receiving a control signal from the computation means.

29. The apparatus according to claim 24, further comprising a plurality of nozzles fluidly coupled to the pressure means such that a pressure fluid from the pressure means may be ejected via at least one of the plurality of nozzles.

30. The apparatus according to claim 29, wherein the computation means is configured to control the fluid coupling between the pressure means and the plurality of nozzles via the control signal.

31. The apparatus according to anyone of claim 24, further comprising communication means communicatively coupled to an external communication unit such as to transmit data from the at least one sensor to the external communication unit.

32. The apparatus according to claim 31, wherein the communication means are further configured to receive the control signal from the external communication unit such as to control the device from the external communication unit.

33. The apparatus according to claim 1, wherein the apparatus further comprises inflatable and deflatable gripping means.

34. A method performed in a hydrocarbon well comprising:

providing a downhole apparatus, the downhole apparatus being configured to move through a well in rock for operation in a in a drilled bore, the downhole apparatus being configured to be installed temporarily or permanently in the drilled bore, the downhole apparatus comprising:

a first part; and a second part connected to the first part, wherein the second part comprises a first electronic device configured to generate a data signal and a first communications device for wirelessly transmitting the generated data signal via a wireless short-range radio-frequency communications channel, wherein the first part comprises a second communications device for wirelessly receiving the transmitted data signal via said wireless short-range radio-frequency communications channel, and wherein the first and second communications devices in use are configured to communicate with each other via the short-range radio-frequency communications channel, wherein the wireless communications channel operates in a 2.4 GHz radio communication spectrum, wherein the first part comprises a reservoir comprising a fluid and sealed from a pressure chamber comprising a fluid and a piston dividing the pressure chamber into a first and a second piston pressure chamber fluidly coupled via a pump;

wherein the second part is attached to the first part via a hollow tubular member extending from the reservoir through the pressure chamber; and wherein the hollow tubular member is attached to the piston such that translation of the piston via a pressure difference between the first and a second piston pressure chamber established by the pump results in translation of the hollow tubular member and the second part;

lowering the apparatus into the borehole; and communicating signals between the first part and the second part.

35. The method according to claim 34, wherein the borehole comprises petroleum oil hydrocarbons in fluid form.

* * * * *